US005719018A

United States Patent [19]

Katsumata et al.

[11] Patent Number: 5,719,018

[45] Date of Patent: Feb. 17, 1998

[54] SILVER HALIDE COLOR LIGHT-SENSITIVE MATERIAL

[75] Inventors: Taiji Katsumata; Hiroo Takizawa; Yasuhiro Yoshioka; Masakazu Morigaki, all of Minami-ashigara, Japan

[73] Assignee: Fuji Photo Film Co., Ltd., Kanagawa, Japan

[21] Appl. No.: 633,382

[22] Filed: Apr. 17, 1996

[30] Foreign Application Priority Data

Apr. 17, 1995 [JP] Japan ..... 7-114035

[51] Int. Cl.[6] ..... G03C 1/08; G03C 7/26; G03C 7/32

[52] U.S. Cl. ..... 430/557; 430/1

[58] Field of Search ..... 430/551, 557

[56] References Cited

U.S. PATENT DOCUMENTS

| | | | |
|---|---|---|---|
| 4,745,049 | 5/1988 | Ohbayashi et al. | 430/557 |
| 5,028,519 | 7/1991 | Morigaki et al. | 430/551 |
| 5,066,574 | 11/1991 | Kubota et al. | 430/557 |

FOREIGN PATENT DOCUMENTS

| | | | |
|---|---|---|---|
| 0706086 | 4/1996 | European Pat. Off. | 430/551 |
| 3085631 | 4/1988 | Japan | 430/557 |
| 2-162345 | 6/1990 | Japan . | |
| 2-193143 | 7/1990 | Japan . | |
| 2-193144 | 7/1990 | Japan . | |
| 2-193145 | 7/1990 | Japan . | |
| 2-193146 | 7/1990 | Japan . | |
| 220047 | 9/1990 | Japan . | |
| 307242 | 11/1993 | Japan . | |

*Primary Examiner*—Geraldine Letscher

[57] ABSTRACT

A silver halide color light-sensitive material is disclosed comprising a support having thereon at least one layer containing at least one yellow dye forming coupler represented by formula (I)

(I)

wherein Z represents a nonmetallic atom group necessary for forming a 5-membered ring represented by formula (II-1) or (II-2):

(II-1)

(II-2)

and the remaining substituents are as defined herein the specification.

21 Claims, No Drawings

SILVER HALIDE COLOR LIGHT-SENSITIVE MATERIAL

FIELD OF THE INVENTION

The present invention relates to a silver halide light-sensitive material containing a novel photographic yellow dye forming coupler.

BACKGROUND OF THE INVENTION

A silver halide color light-sensitive material is exposed and then subjected to color development, whereby an oxidized aromatic primary amine developing agent and a color forming coupler (hereinafter referred to as "coupler") react to form a color image. This method generally uses a color reproduction method according to a subtractive color process, where blue, green and red are reproduced by forming yellow, magenta and cyan color images falling in a complementary color relation to respective colors. In general, the yellow color image is formed using an acylacetamido coupler or a malondianilide coupler as a yellow dye forming coupler (hereinafter referred to as "yellow coupler"), the magenta color image is formed using a 5-pyrazolone coupler or a pyrazolotriazole coupler as a magenta coupler, and the cyan color image is formed using a phenol coupler or a naphthol coupler as a cyan coupler.

The yellow dye, the magenta dye and the cyan dye obtained from these couplers each is generally formed in a silver halide emulsion layer or a layer adjacent thereto having spectral sensitivity to the radiation falling in a complementary color relation to the radiation to be absorbed by the dye. As the yellow coupler, particularly for forming an image, an acylacetamido coupler represented by a benzoylacetanilide coupler and a pivaloylacetanilide coupler is commonly used. The former generally exhibits a high coupling activity with the oxidation product of an aromatic primary amine developing agent upon development and at the same time, provides a large molecular extinction coefficient of the yellow dye formed, accordingly, it is mainly used for a color light-sensitive material requiring high sensitivity, particularly for a color negative film. The latter is excellent in the spectral absorption property and in the fastness, accordingly, it is mainly used for color paper or color reversal film.

For example, JP-A-2-162345 (the term "JP-A" as used herein means an "unexamined published Japanese patent application") discloses pivaloylacetanilide yellow couplers and JP-A-2-193143, JP-A-2-193144, JP-A-2-193145 and JP-A-2-193146 disclose benzoylacetanilide yellow couplers, however, the couplers described in these patent publications are yet unsatisfactory in the fastness of color image to light, heat and humidity and in the aging stability during cold storage of the emulsified product.

In recent years, the silver halide color light-sensitive material is being demanded to be available at the low cost using cheap couplers. However, known couplers using cheap raw materials are inferior in the color forming property and low in the solubility in a high boiling point organic solvent and as a result, the emulsified product is disadvantageously poor in the aging stability during cold storage. In particular, there are tendencies that those satisfied in the color forming property are low in the solubility in a high boiling point organic solvent and those satisfied in the solubility are inferior in the color forming property. Also, dyes obtained from these couplers are insufficient in the image fastness and couplers capable of providing a dye having high fastness are being demanded to be developed.

SUMMARY OF THE INVENTION

An object of the present invention is, accordingly, to provide a silver halide color light-sensitive material containing a yellow dye forming coupler having excellent color forming property.

Another object of the present invention is to provide a silver halide color light-sensitive material containing a yellow dye forming coupler superior in the solubility in an organic solvent and excellent in the aging stability during cold storage of the emulsified product.

Still another object of the present invention is to provide a silver halide color light-sensitive material containing a yellow dye forming coupler capable of providing a color image excellent in the fastness to light, heat and humidity.

Another object of the present invention is to provide a silver halide color light-sensitive material containing a yellow dye forming coupler causing little yellow stains.

Still another object of the present invention is to provide a silver halide color light-sensitive material containing a yellow dye forming coupler capable of being produced using unexpensive starting materials.

These objects of the present invention can be achieved by a silver halide color light-sensitive material comprising a support having thereon at least one layer containing at least one yellow dye forming coupler (yellow coupler) represented by the following formula (I):

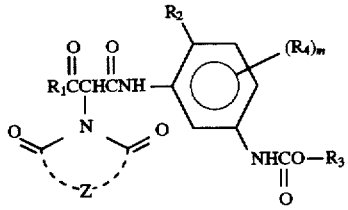

(I)

wherein $R_1$ represents an alkyl group, a cycloalkyl group, an aryl group, an alkylamino group, an anilino group or a heterocyclic group, $R_2$ represents a hydrogen atom, an aliphatic group, a halogen atom, an aliphatic oxy group, an aryloxy group or an amino group, $R_3$ represents an acyclic aliphatic group or an aryl group, $R_4$ represents a substituent, m represents 0 or an integer of from 1 to 3, and Z represents a nonmetallic atom group necessary for forming a 5-, 6-, 7- or 8-membered ring comprising a ring constituent atom(s) selected from the group consisting of a carbon atom, a nitrogen atom, an oxygen atom and a sulfur atom, provided that when two or more hetero atoms (i.e., N, O and S) are contained in the ring constituent atoms, the hetero atoms do not bond directly each other. Use of the yellow couplers of formula (I) wherein $R_3$ represents an unsubstituted branched alkyl group is particularly preferred.

DETAILED DESCRIPTION OF THE INVENTION

The yellow coupler represented by formula (I) of the present invention is described below in detail.

In the present specification, unless otherwise indicated, the aliphatic group or the aliphatic moiety in the aliphatic oxy group may be linear, branched or cyclic, may contain an unsaturated bond or may be substituted by a substituent known for yellow couplers. In other words, the aliphatic group described in the present specification includes alkyl, alkenyl, alkynyl, cycloalkyl and aralkyl.

In the present specification, unless otherwise indicated, the alkyl group or the alkyl group in the alkylamino group may be linear or branched or may be substituted by a substituent known for yellow couplers.

In the present specification, unless otherwise indicated, the cycloalkyl group may be substituted by a substituent known for yellow couplers or may be formed into a condensed ring.

In the present specification, unless otherwise indicated, the aryl group or the aryl moiety in the heterocyclic group or in the aryloxy group may be substituted by a substituent known for yellow couplers or may be formed into a condensed ring.

In the present specification, unless otherwise indicated, the anilino group may be substituted at the phenyl group or the N-position of the anilino group by a substituent known for yellow couplers.

In the present specification, unless otherwise indicated, the amino group may be substituted by a substituent known for yellow couplers.

When the compound of the present invention contains geometrical isomers such as an unsaturated bond, isomers of only one kind may be present or a mixture of isomers may be present.

In formula (I), $R_1$ is preferably an alkyl group having from 1 to 1 to 30 carbon atoms (e.g., methyl, ethyl, i-propyl, t-butyl, t-pentyl, octyl, benzyl), a cycloalkyl group having from 3 to 30 carbon atoms (e.g., cyclopropyl, 1-methylcyclopropyl, 1-ethylcyclopropyl, 1-benzylcyclopropyl, cyclopentyl, 1-methylcyclohexyl, cyclohexyl), an aryl group having from 6 to 36 carbon atoms (e.g., phenyl, 2-naphthyl, 4-methylphenyl, 4-methoxyphenyl, 3-acetylaminophenyl, 2-chlorophenyl), a heterocyclic group having from 1 to 30 carbon atoms (e.g., indolinyl, 3,5-dioxanyl, 1-methyl-3,5-dioxanyl), an alkylamino group having from 1 to 30 carbon atoms (e.g., N-methylamino, N,N-dimethylamino) or an anilino group having from 6 to 36 carbon atoms (e.g., anilino, N-methylanilino), more preferably, an alkyl group, a cycloalkyl group, an aryl group or a heterocyclic group, still more preferably a t-butyl group, a 1-methylcyclopropyl group, a 1-ethylcyclopropyl, a 1-benzylcyclopropyl group, a 4-methoxyphenyl group or an indolinyl group, particularly preferably a t-butyl group, a 1-ethylcyclopropyl group or a 4-methoxyphenyl group, and most preferably a t-butyl group.

In formula (I), $R_2$ is preferably a hydrogen atom, a halogen atom (e.g., fluorine, chlorine, bromine, iodine), an aliphatic oxy group having from 1 to 30 carbon atoms (e.g., methoxy, i-propoxy, t-butoxy, benzyloxy, cyclohexyloxy), an aryloxy group having from 6 to 36 carbon atoms (e.g., phenoxy, 2,4,-t-butylphenoxy, 2-naphthoxy, 4-methoxyphenoxy, 2-chlorophenoxy), an aliphatic group having from 1 to 30 carbon atoms (e.g., methyl, i-propyl, t-butyl, benzyl, trifluoromethyl, cyclohexyl) or an amino group having from 0 to 30 carbon atoms (e.g., N,N-dimethylamino, N-cyclohexylamino, N-butylamino), more preferably a halogen atom, an aliphatic oxy group or an aryloxy group, still more preferably a chlorine atom or a methoxy group, and most preferably a chlorine atom.

In formula (I), $R_3$ represents an acyclic aliphatic group or an aryl group. In the present invention, the acyclic aliphatic group may be linear or branched, may contain an unsaturated bond or may be substituted by a substituent known for yellow couplers. More specifically, examples of the alicyclic aliphatic group include an alkyl group and an alkenyl group. The alkyl group is preferably an alkyl group having from 1 to 20 carbon atoms, such as methyl, t-butyl, octyl, 2-ethylhexyl, dodecyl, 3,5,5-trimethylhexyl, i-tridecyl, hexadecyl, 2-hexyldecyl, 5,7,7-trimethyl-2-(1,3,3-trimethylbutyl)octyl, benzyl, 2-butoxyethyl, tetradecyl and octadecyl, and the alkenyl group is preferably an alkenyl group having from 2 to 20 carbon atoms, such as oleyl, vinyl, linol, resinol, linolen and 10-decenyl. The aryl group is preferably an aryl group having from 6 to 26 carbon atoms, such as phenyl, 2,4-di-t-pentylphenyl, 4-octyloxyphenyl and 3-methylphenyl. $R_3$ is preferably a linear or branched alkyl group having from 1 to 20 carbon atoms or an alkenyl group having from 3 to 20 carbon atoms, more preferably an unsubstituted linear or branched alkyl group having from 8 to 18 carbon atoms, and most preferably an unsubstituted branched alkyl group having from 8 to 18 carbon atoms.

In formula (I), $R_4$ represents a substituent and $R_4$ is preferably an aliphatic group having from 1 to 30 carbon atoms (e.g., methyl, ethyl, i-propyl, t-butyl, benzyl), an aliphatic oxy group having from 1 to 30 carbon atoms (e.g., methoxy, i-propyloxy, t-butoxy, benzyloxy, 2-ethylhexyloxy, hexadecyloxy, cyclohexyloxy), an acylamino group having from 2 to 30 carbon atoms (e.g., acetylamino, benzylamino, pivaloylamino), a carbamoyl group having from 1 to 30 carbon atoms (e.g., N-methylcarbamoyl, N-phenylcarbamoyl, N,N-dibutylcarbamoyl, N-methyl-N-phenylcarbamoyl), an alkoxycarbonyl group having from 2 to 30 carbon atoms (e.g., methoxycarbonyl, hexyloxycarbonyl, octadecyloxycarbonyl), an alkylsulfonamide group having from 1 to 30 carbon atoms (e.g., methanesulfonamide, octanesulfonamide, hexadecanesulfonamide), an arylsulfonamide group having from 6 to 36 carbon atoms (e.g., benzenesulfonamide, p-chlorobenzenesulfonamide), a cyano group, a nitro group or a halogen atom (e.g., chlorine, bromine), more preferably an aliphatic group, an aliphatic oxy group or a halogen atom.

In formula (I), m represents 0 or an integer of from 1 to 3 and m is preferably 0 or 1, more preferably 0.

In formula (I), Z represents a nonmetallic atom group necessary for forming a 5-, 6-, 7- or 8-membered ring comprising a ring constituent atom or atoms selected from a carbon atom, a nitrogen atom, an oxygen atom and a sulfur atom, provided that when two or more hetero atoms (i.e., N, O and S) are contained in the ring constituent atoms, the hetero atoms do not bond directly each other. Z may be substituted by a substituent known for yellow couplers. Examples of the known substituent include substituents described above for $R_4$, an aryl group, an aryloxy group, a hydroxy group and an acyl group. The nonmetallic atom is preferably a carbon atom, a nitrogen atom or an oxygen atom, more preferably a carbon atom or a nitrogen atom. The ring formed by Z is preferably a 5- or 6-membered ring, more preferably a 5-membered ring, and the ring may be condensed with another ring.

The ring formed by Z is preferably a ring represented by the following formula (II-1) or (II-2):

(II-1)

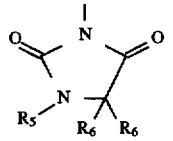

(II-2)

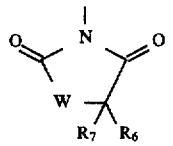

wherein $R_6$ and $R_7$ each independently preferably represents a hydrogen atom, an alkyl group having from 1 to 20 carbon atoms (e.g., methyl, ethyl, i-propyl, t-butyl, benzyl), an aryl group having from 6 to 26 carbon atoms (e.g., phenyl, 2-naphthyl, 4-methoxyphenyl, 3-chlorophenyl, 2-methylphenyl), an alkoxy group having from 1 to 20 carbon atoms (e.g., methoxy, ethoxy, i-propyloxy, t-butoxy), an aryloxy group having from 6 to 26 carbon atoms (e.g., phenoxy) or a hydroxy group, more preferably a hydrogen atom, an alkyl group having from 1 to 10 carbon atoms or an alkoxy group having from 1 to 10 carbon atoms, still more preferably a hydrogen atom, a methyl group, a methoxy group or an ethoxy group.

$R_5$ preferably represents a hydrogen atom, an alkyl group having from 1 to 20 carbon atoms, an aryl group having from 1 to 20 carbon atoms (preferred examples of the aryl group are the same as those for $R_6$), an aralkyl group having from 7 to 20 carbon atoms (e.g., benzyl, phenethyl) or an acyl group having from 1 to 20 carbon atoms (e.g., acetyl, benzoyl), more preferably a hydrogen atom, an alkyl group or an aralkyl group, more preferably a hydrogen atom, a methyl group, an ethyl group or a benzyl group.

In formula (II-2), W represents an oxygen atom or a sulfur atom, preferably an oxygen atom.

In formula (II-1), preferably, $R_5$ is a hydrogen atom, an alkyl group having from 1 to 4 carbon atoms or a benzyl group, and $R_6$ and $R_7$ each is a hydrogen atom, an alkyl group having from 1 to 4 carbon atoms or an alkoxy group having from 1 to 4 carbon atoms; more preferably, $R_5$, $R_6$ and $R_7$ each is a hydrogen atom or an alkyl group having from 1 to 4 carbon atoms; still more preferably, $R_5$ is a hydrogen atom and $R_6$ and $R_7$ each is a methyl group, or $R_5$ is a methyl group and $R_6$ and $R_7$ each is a hydrogen atom; and most preferably, $R_5$ is a hydrogen atom and $R_6$ and $R_7$ each is a methyl group.

In formula (II-2), preferably, W is an oxygen atom and $R_6$ and $R_7$ each is a methyl group.

In formula (I), the ring formed by Z is preferably a ring represented by formula (II-1).

Specific examples of the rings formed by Z are set forth below, but the present invention is by no means limited thereto.

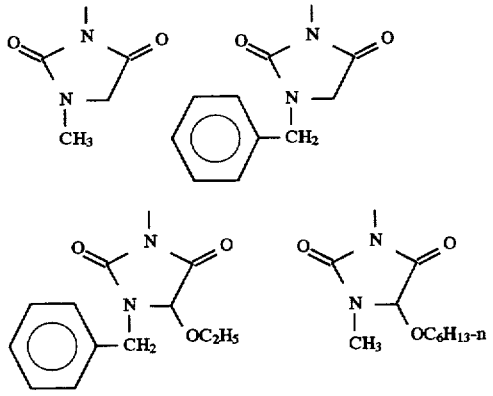

-continued

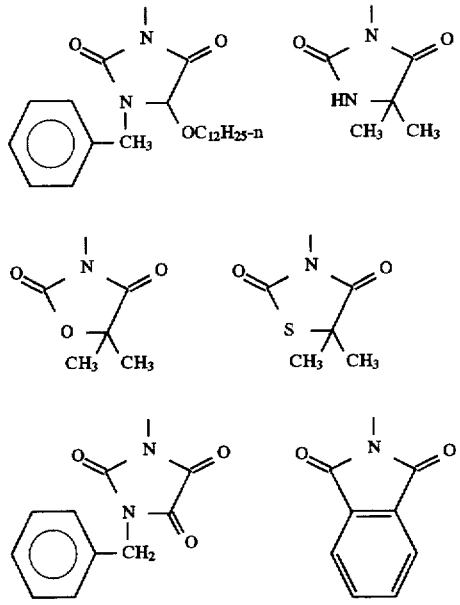

The yellow coupler represented by formula (I) may also be linked at the site of $R_1$, $R_2$, $R_4$ or Z through a divalent or other polyvalent group to form a dimer or polymer. In this case, the carbon number may exceed the range prescribed above for each substituent.

In the yellow coupler represented by formula (I), a preferred combination is such that $R_5$ is an alkyl group and Z is a ring represented by formula (II-1) or (II-2), and a more preferred combination is such that $R_1$ is a t-butyl group, $R_2$ is a chlorine atom or a methoxy group and the ring formed by Z is a ring represented by formula (II-1). Further, in this case, a more preferred combination is such that $R_2$ is a chlorine atom, $R_3$ is an unsubstituted linear or branched alkyl group, the ring formed by Z is a ring represented by formula (II-1) where $R_5$ is a hydrogen atom and $R_6$ and $R_7$ each is a methyl group, and in this combination, $R_3$ is particularly preferably an unsubstituted branched alkyl group.

Preferred examples of the yellow coupler represented by formula (I) of the present invention are set forth below, but the present invention is by no means limited thereto.

Y-1

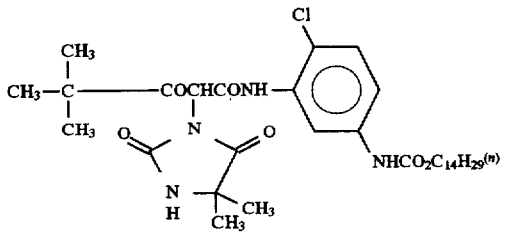

Y-2

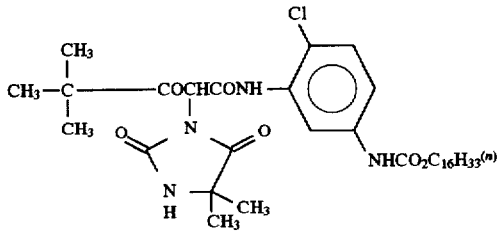

-continued
Y-3
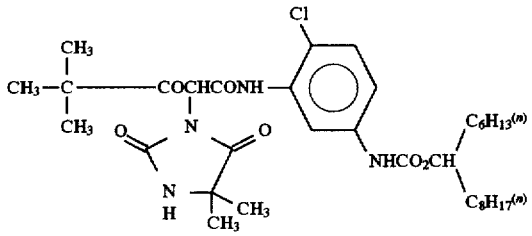
Y-4
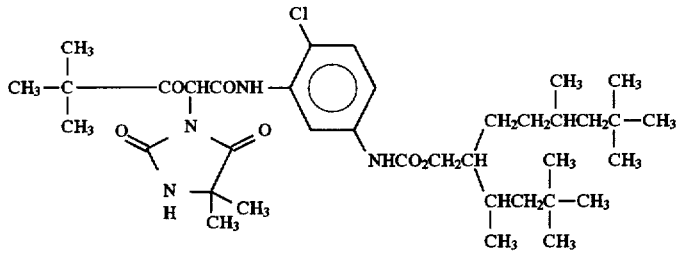
Y-5
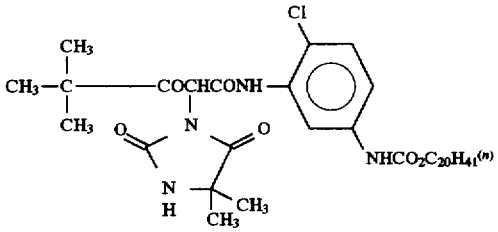
Y-6
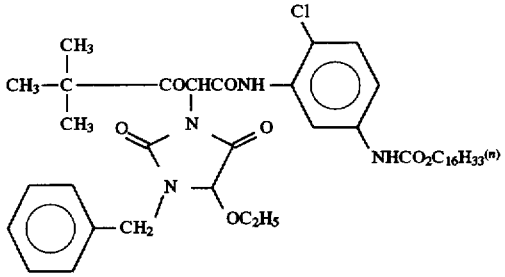
Y-7
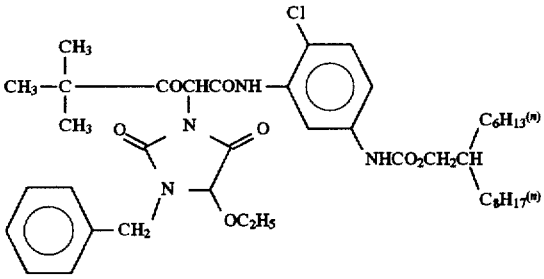
Y-8
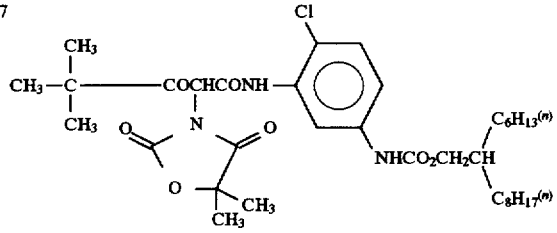
Y-9
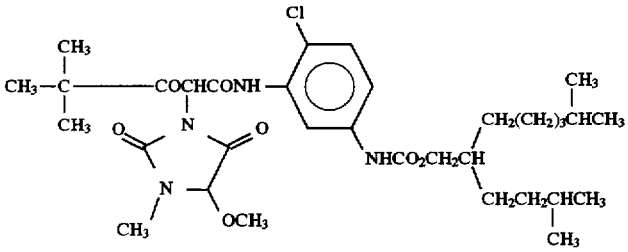
Y-10
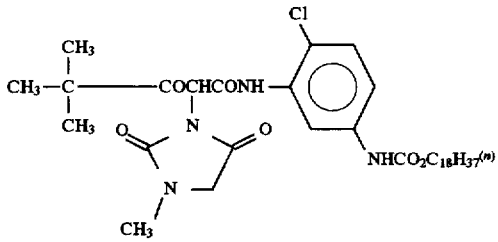
Y-11
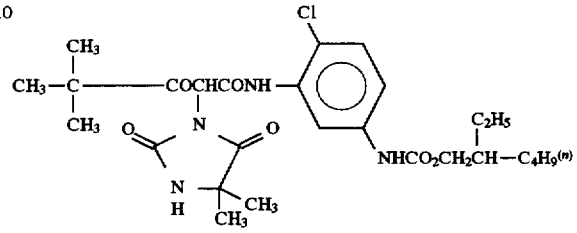

-continued
Y-12
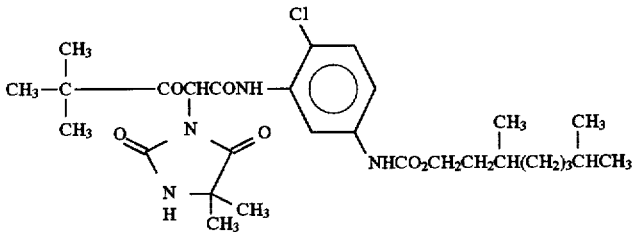
Y-13
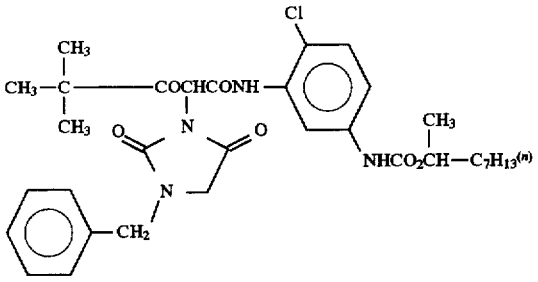
Y-14
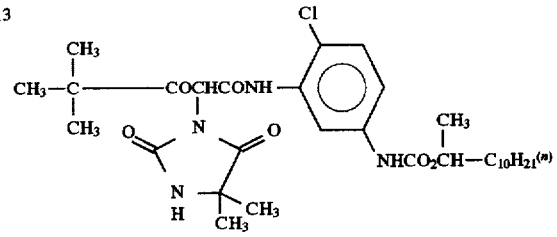
Y-15
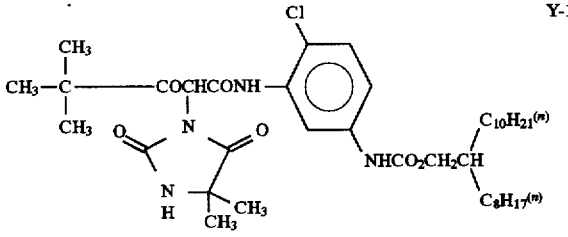
Y-16
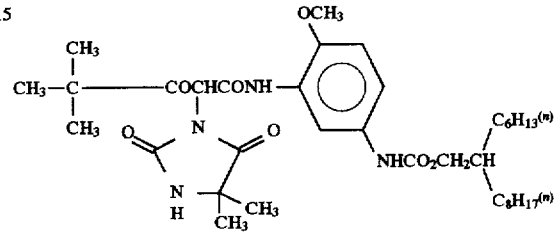
Y-17
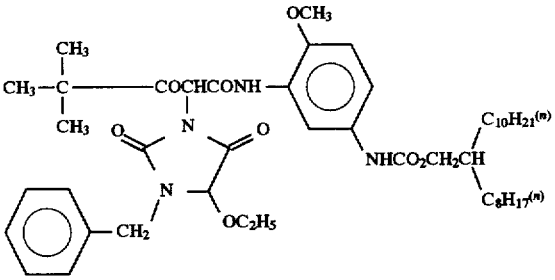
Y-18
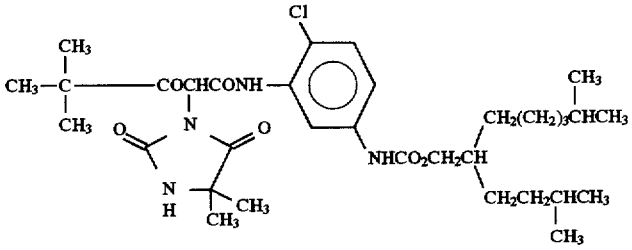
Y-19
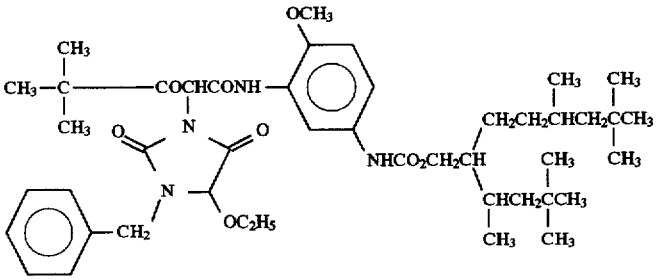

-continued
Y-20
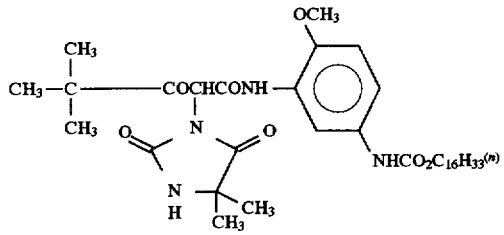
Y-21
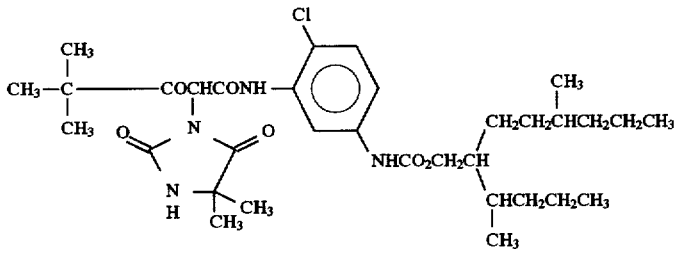
Y-22
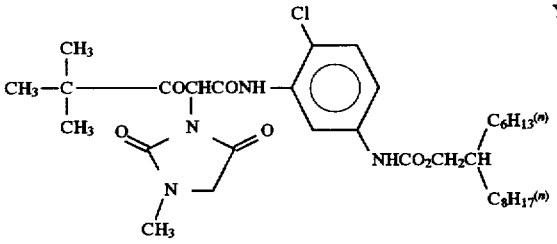
Y-23
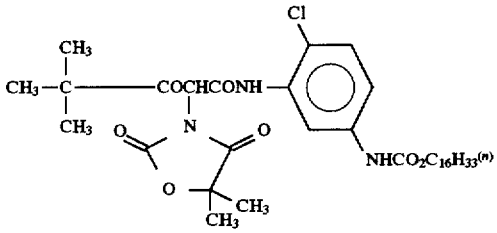
Y-24
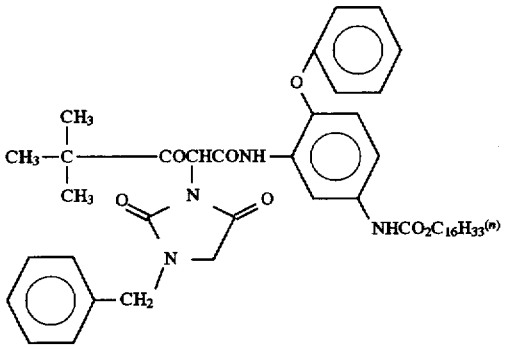
Y-25
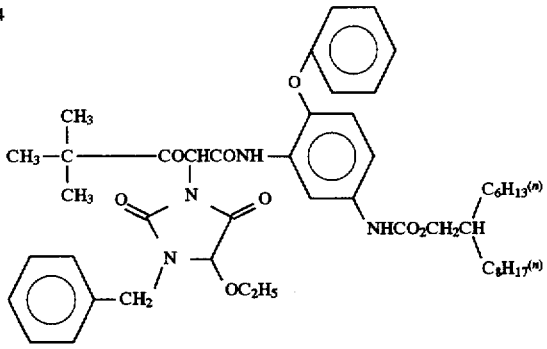
Y-26
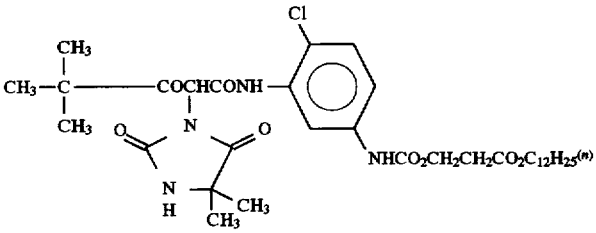
Y-27
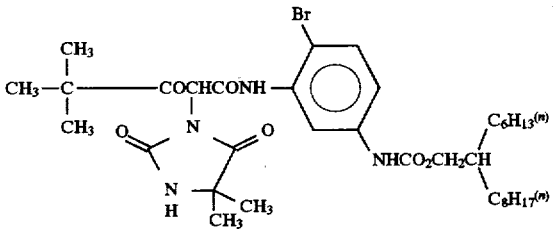
Y-28
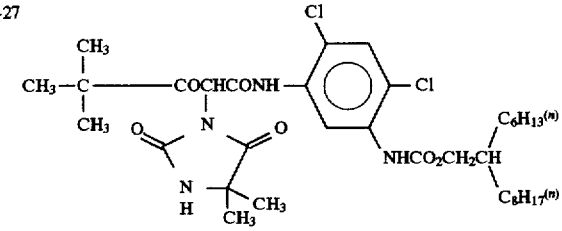

-continued
Y-29
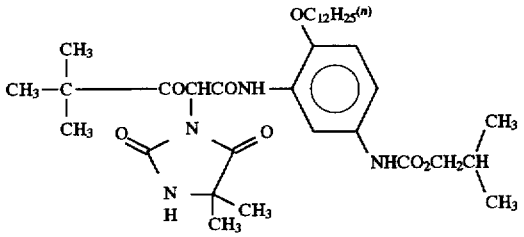
Y-30
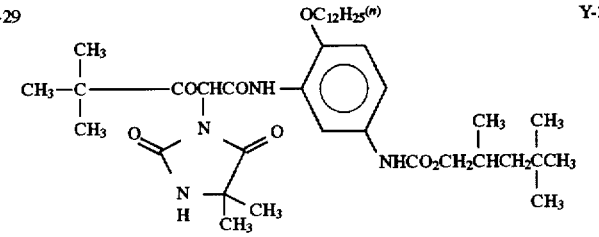
Y-31
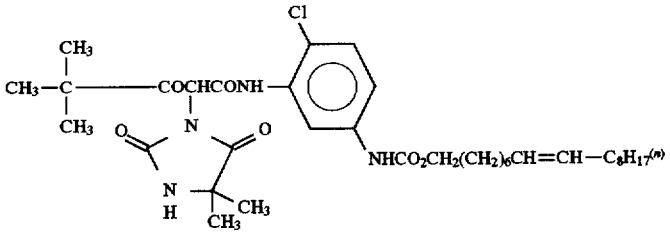
Y-32
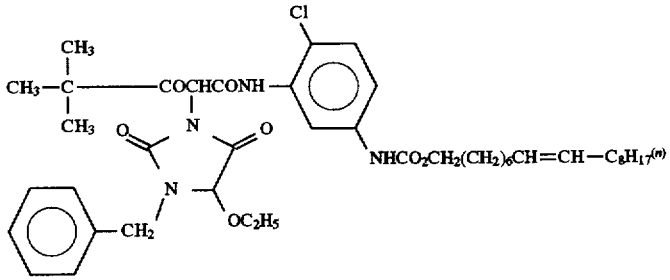
Y-33
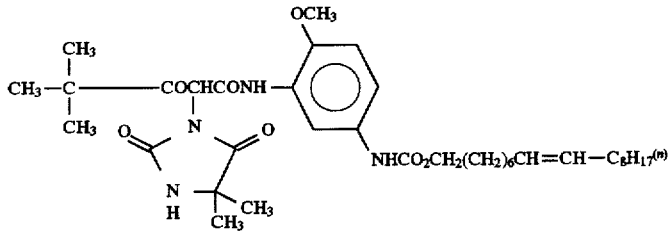
Y-34
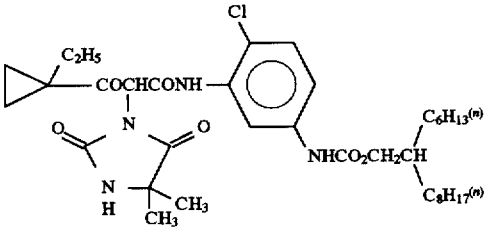
Y-35
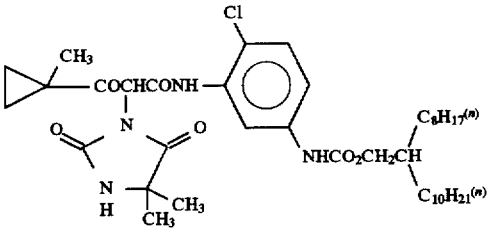
Y-36
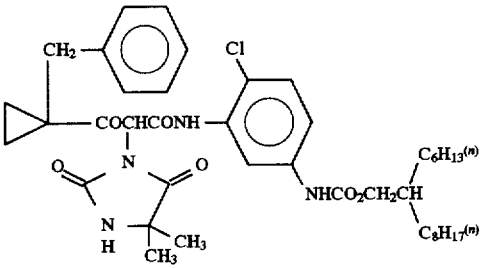

-continued
Y-37
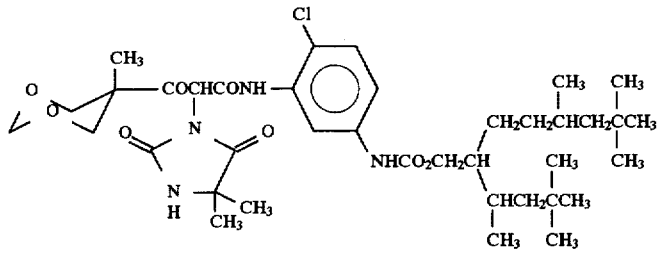
Y-38
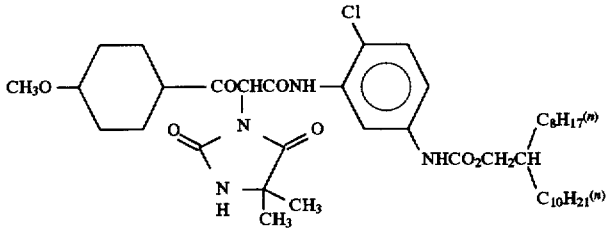
Y-39
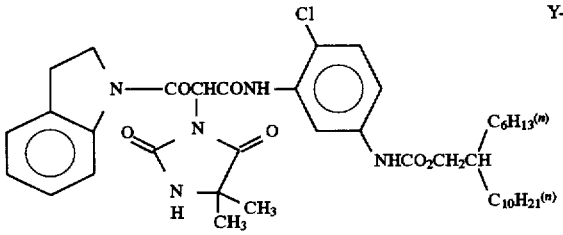
Y-40
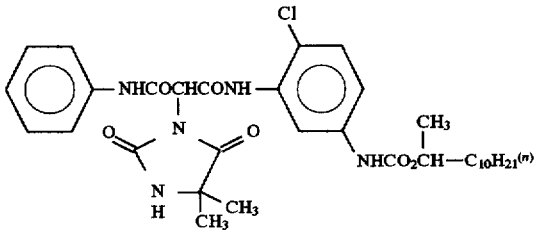
Y-41
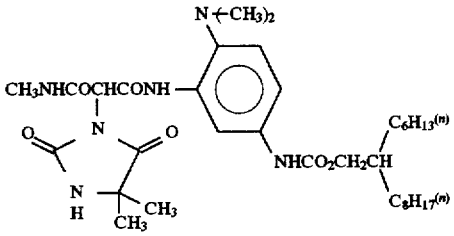
Y-42
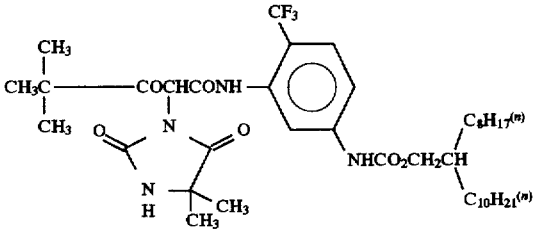
Y-43
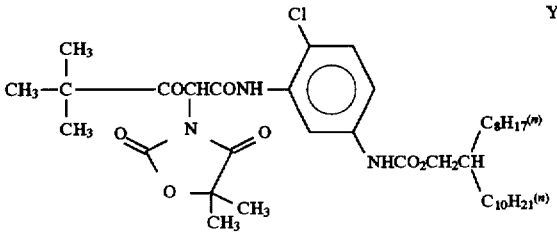
Y-44
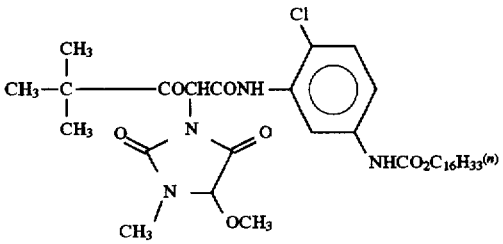
Y-45
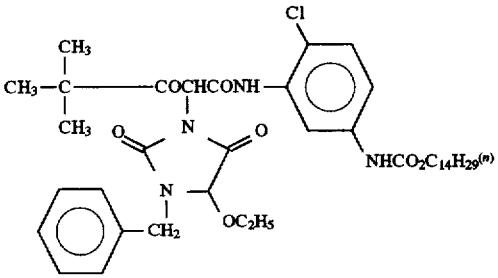

-continued

Y-46

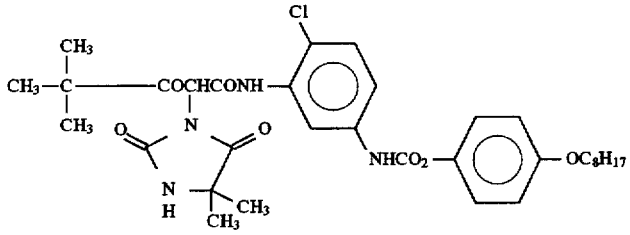

Y-47

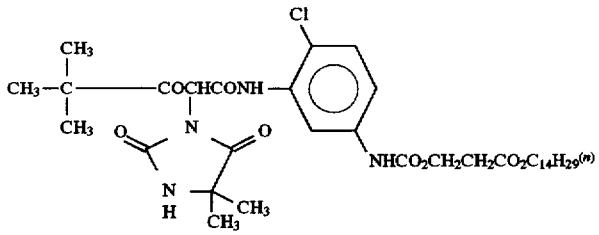

The yellow coupler represented by formula (I) may be synthesized by reacting an aniline form of the coupler where $—NHCO_2R_3$ in formula (I) is $—NH_2$ and which can be synthesized by a known method, with a chloroformic acid $R_3OCOCl$ in a solvent such as acetonitrile, dimethylformamide or ethyl acetate using a deoxidizing agent such as triethylamine, pyridine or potassium carbonate.

A specific synthesis example of the yellow coupler of the present invention is described below, but the present invention is by no means limited thereto.

(1) Synthesis of Yellow Coupler Y-3

Yellow Coupler Y-3 was synthesized through the following route.

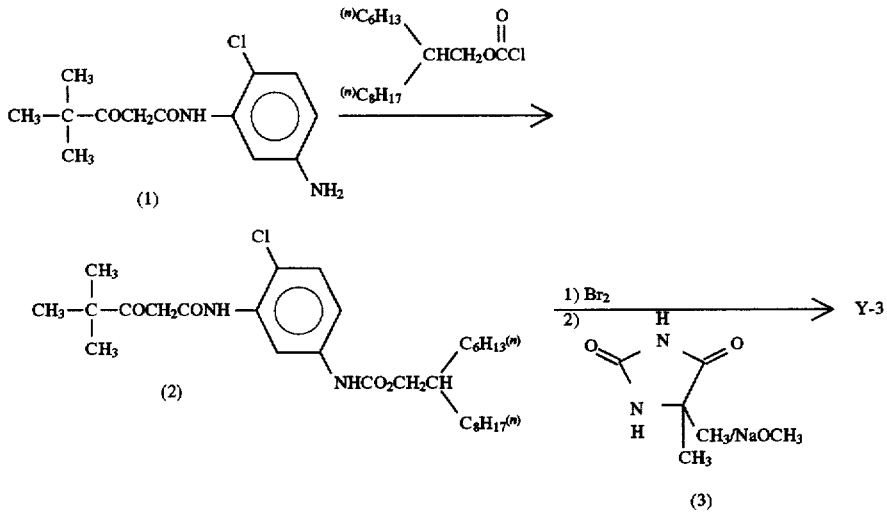

Synthesis of Compound (2):

Aniline Compound (1) (22.2 g, 0.082 mol) and 7.4 ml (0.091 mol) of pyridine were dissolved in 200 ml of dimethylacetamido, followed by stirring, and thereto 14.7 g (0.041 mol) of isopalmitic chloroformate was added dropwise at 10° C. over 40 minutes. The reaction solution was stirred at room temperature for one hour and, after adding thereto 300 ml of water, extracted with 300 ml of ethyl acetate. The organic layer was washed with water and with brine, dried over magnesium sulfate and concentrated. The resulting residue was purified by a column chromatography (developer solvent: ethyl acetate/hexane=1/4) to obtain 36.2 g of Compound (2) (yield: 55%).

Synthesis of Yellow Coupler Y-3:

Compound (2) (36.2 g, 0.067 mol) was dissolved in 100 ml of methylene chloride, followed by stirring, and thereto 11.1 g (0.072 mol) of bromine was added dropwise at 5° C. over 30 minutes. The reaction solution was stirred at from 5° to 10° C. for 2 hours, washed twice by adding thereto 200 ml of water, and dried.

Hydantoin compound (3) (25.9 g, 0.202 mol) was dissolved in 130 ml of ethyl acetate and 100 ml of dimethylacetamido and thereto, 26 g (0.137 mol) of a methanol solution containing 28 wt % of sodium methoxide was added. A methylene chloride solution containing a hydantoin compound was added dropwise while stirring at from 10° to 15° C. over one hour. The reaction solution was stirred at from 10° to 15° C. for one hour and, after adding thereto diluted hydrochloric acid solution, extracted with ethyl acetate. The organic layer was washed four times with water and with brine, dried over magnesium sulfate and concentrated. The resulting residue was purified by a column chromatography (developer solvent: ethyl acetate/hexane=

1/2) and recrystallized from n-hexane to obtain 31.6 g of yellow Coupler Y-3 as white crystal (yield: 70.7%, m.p.: 132°–136° C.).

As the yellow coupler for use in the present invention, one or more yellow couplers represented by formula (I) may be used or other known yellow couplers may be used in combination.

The layer where the yellow coupler represented by formula (I) is added may be any layer as long as it is a hydrophilic colloid layer, however, it is preferably a blue-sensitive silver halide emulsion layer.

The amount of the yellow coupler represented by formula (I) of the present invention in a silver halide color light-sensitive material (hereinafter, sometimes referred to as "light-sensitive material") is preferably from 0.01 to 10 mmol/m$^2$, more preferably from 0.05 to 5 mmol/m$^2$, most preferably from 0.1 to 2 mmol/m$^2$. The couplers represented by formula (I) may of course be used in combination of two or more thereof or may also be used in combination with a coupler other than the couplers represented by formula (I).

A preferred embodiment of the present invention is a silver halide color light-sensitive material containing a compound represented by the following formula (III) in the layer containing the yellow coupler of formula (I):

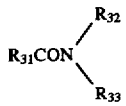

(III)

wherein $R_{31}$, $R_{32}$ and $R_{33}$ each independently represents a hydrogen atom, an aliphatic group or an aryl group, provided that the total number of the carbon atoms of $R_{31}$, $R_{32}$ and $R_{33}$ is from 9 to 80.

The compound represented by formula (III) is described in detail below.

In formula (III), $R_{31}$, $R_{32}$ and $R_{33}$ each preferably represents a hydrogen atom, an aliphatic group having from 1 to 40 carbon atoms (e.g., methyl, ethyl, t-butyl, i-propyl, benzyl, 1-(2,4-di-t-amylphenoxy)propyl, heptyl, undecyl, 1-ethylpentyl, cyclohexyl, 9-decenyl, 1-hexylnonyl, 2-ethylhexyl, dodecyl, 1-hexyldecyl, octyl, 4,6,6-trimethyl-1-(1,3,3-trimethylbutyl)heptyl) or an aryl group having from 6 to 40 carbon atoms (e.g., phenyl, 2-naphthyl, 2-chlorophenyl, 3-methylphenyl, 4-octyloxyphenyl), provided that the total carbon number of $R_{31}$, $R_{32}$ and $R_{33}$ is from 9 to 80, preferably from 13 to 60, more preferably from 15 to 50. $R_{31}$ and $R_{32}$ or $R_{32}$ and $R_{33}$ may be linked with each other to form a ring (e.g., piperidine, piperazine, morpholine, pyrrolidine, triazine).

The compound represented by formula (III) of the present invention may be linked at the site of $R_{31}$, $R_{32}$ or $R_{33}$ to form an oligomer or a polymer and in this case, the carbon number may exceed the range prescribed above.

The compound represented by formula (III) is preferably represented by the following formula (IV):

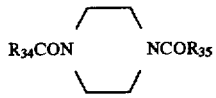

(IV)

wherein $R_{34}$ and $R_{35}$ each has the same meaning as defined for $R_{31}$ in formula (III) and the total carbon number of $R_{34}$ and $R_{35}$ is from 12 to 75.

In formula (IV), the substituents $R_{34}$ and $R_{35}$ are preferably the same and in this case, $R_{34}$ and $R_{35}$ both are preferably an alkyl group having from 8 to 26 carbon atoms, more preferably a branched alkyl group represented by the following formula (V):

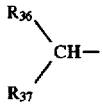

(V)

wherein $R_{36}$ represents a linear or branched alkyl group having from 4 to 13 carbon atoms and $R_{37}$ represents a linear or branched alkyl group having from 2 to 11 carbon atoms. Preferably, $R_{36}$ is a branched alkyl group having from 7 to 13 carbon atoms and $R_{37}$ is a branched alkyl group having from 5 to 11 carbon atoms, more preferably, $R_{36}$ is a branched alkyl group having from 9 to 10 carbon atoms and $R_{37}$ is a branched alkyl group having 7 to 8 carbon atoms. Most preferred is the case where the carbon atom number of $R_{37}$ is 2 smaller than that of $R_{36}$.

Specific examples of the compound represented by formula (III) are set forth below, but the present invention is by no means limited thereto. In the following, when the description such as $C_8H_{17}$-i is given, it may have either single form in branching or a mixture of several forms. For example, when $C_8H_{17}$-i is given, it may be a mixture of 2-ethylhexyl, 2-ethyl-4-methylpentyl and 2,2,4-trimethylpentyl.

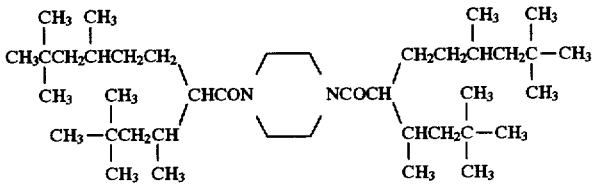

S-1

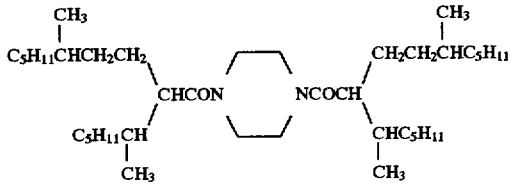

S-2

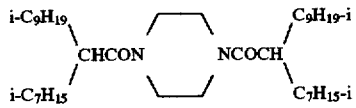

S-3

-continued
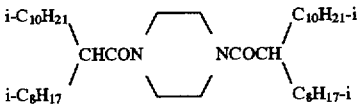
S-4
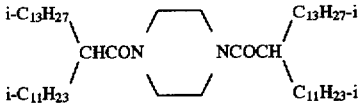
S-5
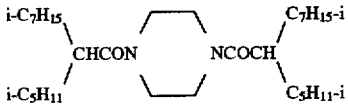
S-6
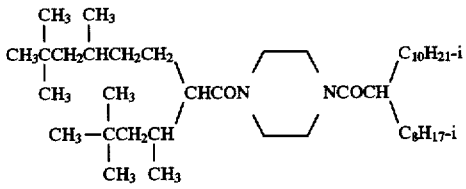
S-7
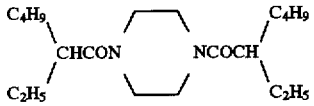
S-8
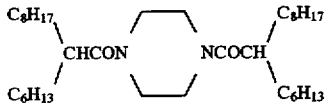
S-9
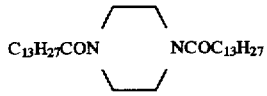
S-10
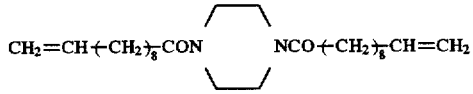
S-11
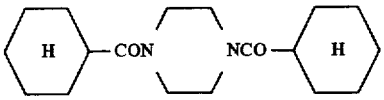
S-12
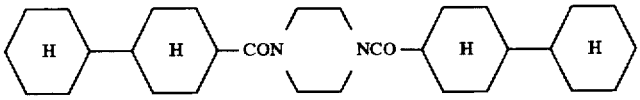
S-13
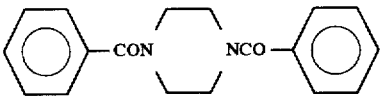
S-14
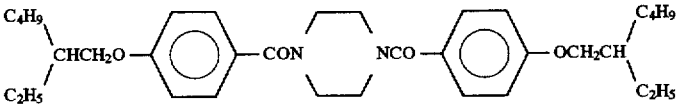
S-15
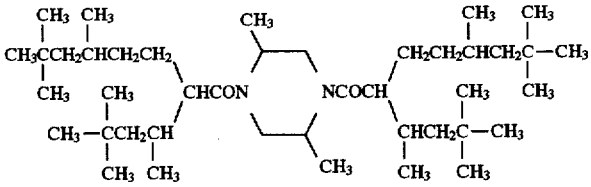
S-16

-continued
S-17
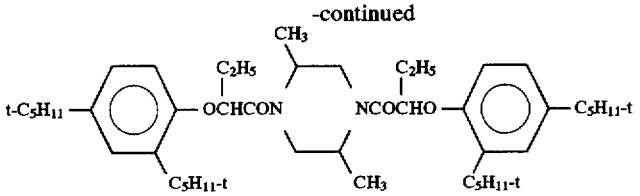
S-18
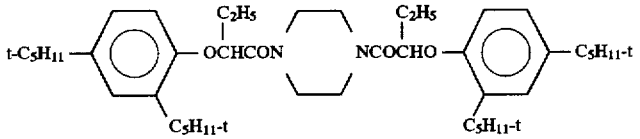
S-19
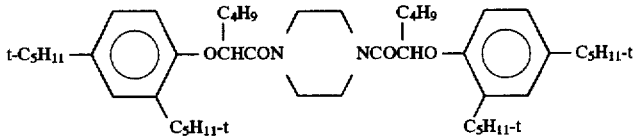
S-20
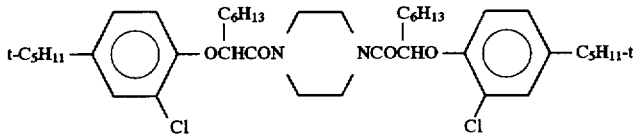
S-21
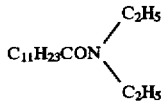
S-22
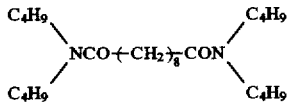
S-23
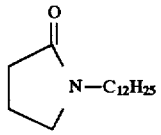
S-24
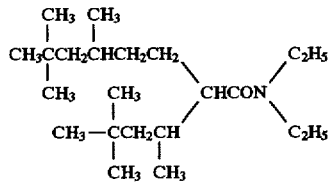
S-25
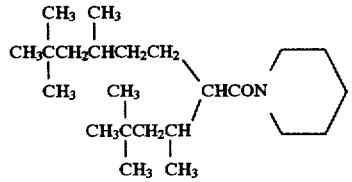
S-26
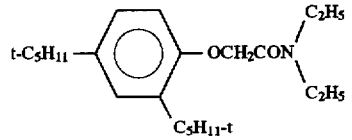
S-27
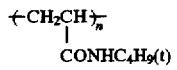
average molecular weight:
60,000

-continued $C_8H_{17}CH{=}CH(CH_2)_7CONH_2$ S-28

$C_8H_{17}CH{=}CH(CH_2)_7CONH(CH_2)_8CH{=}CHC_8H_1$ S-29

$i\text{-}C_{17}H_{35}CONHCH{=}CH_2NHCOC_{17}H_{35}\text{-}i$ S-30

S-31

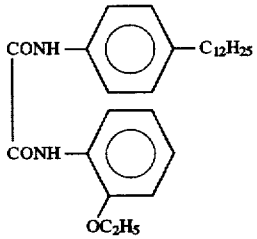

S-32

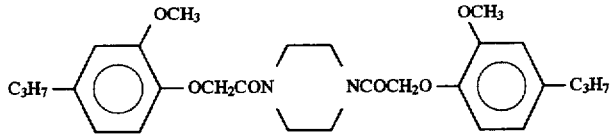

S-33

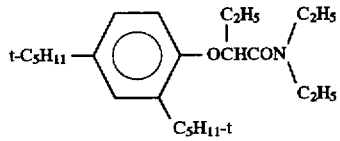

S-34

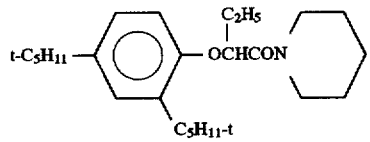

A synthesis example of the compound represented by formula (III) is described below.

The compound represented by formula (III) can be easily synthesized by converting a carboxylic acid into a carboxylic acid chloride using thionyl chloride, phosphorous trichloride or oxalyl chloride and then reacting the carboxylic acid chloride with an amine using triethylamine, sodium carbonate or potassium carbonate as a deoxidizing agent.

Synthesis of Compound S-1:

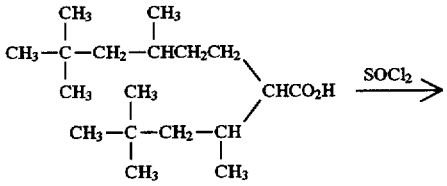

isostearic acid
("FINEOXOCOL",
produced by
Nissan Chemical KK)

-continued

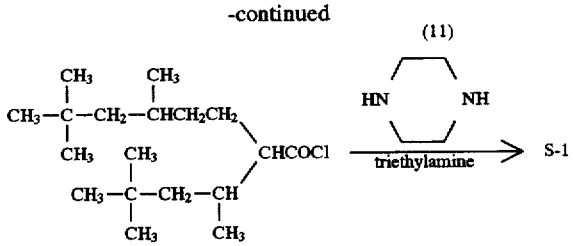

(11)

To 568.9 g (2 mol) of an isostearic acid produced by Nissan Chemical KK, 1.0 g of DMF was added and thereto, 261.8 g (2.2 mol) of thionyl chloride was added dropwise while stirring over 30 minutes. The mixture was stirred at room temperature for 30 minutes, stirred at 40° C. for 30 minutes and concentrated under reduced pressure using an aspirator to obtain 605.8 g (yield: 100%) of a carboxylic acid chloride (10). Separately, 86.1 g (1 mol) of a piperazine anhydride (11) and 242.8 g (2.4 mol) of triethylamine were dissolved in 1,250 ml of ethyl acetate and the mixture was stirred while cooling with ice water. Then, thereto, 605.8 g of the carboxylic acid chloride obtained above was added dropwise over one hour. The mixture was stirred for 30 minutes and after raising the temperature to 50° C., further stirred for one hour.

The organic phase was extracted by adding 500 ml of water, washed three times with water, dried over magnesium sulfate and then concentrated to obtain 607.0 g (yield: 98.1%) of Compound S-1 as a light yellow oily product.

The structure was verified by NMR, IR, MS spectrum and gas chromatography.

NMR Spectrum (300 MHz, $CDCl_3$, δ:ppm)

1.0–1.2 (48H, S or d, $CH_3$)

1.2–2.0 (20H, m, —$CH_2$— and >CH—)

2.4–2.7 (2H, m, —COCH<)

3.6–4.0 (8H, m, >$NCH_2CH_2N$<)

MS Spectrum 618 ($M^+$), 603, 551, 463, 353

The compounds represented by formula (III) of the present invention may be used individually or in combination or may be used in combination with a known discoloration inhibitor.

The compound represented by formula (III) functions mainly as a high boiling point organic solvent but it may be used in combination with a known high boiling point organic solvent or may be used as an additive, for example, as a stabilizer. The term "high boiling point" as used herein means a boiling point of 175° C. or higher at normal pressure. It is preferred that the compound of formula (III) be co-emulsified with the yellow coupler of formula (I) and incorporated into the same layer to which the yellow coupler is added.

The used amount of the compound represented by formula (III) may be varied depending upon the purpose and it is not particularly restricted. The amount is preferably from 0.0002 to 20 g, more preferably from 0.001 to 5 g, per $m^2$ of the light-sensitive material, and it is from 0.1 to 8 parts by weight, more preferably from 0.1 to 4.0 parts by weight, still more preferably from 0.2 to 1.0 part by weight, per part by weight of the total amount of the couplers (e.g., the coupler of formula (I)) contained in the same layer.

In the case when the compound represented by formula (III) is used in combination with a known high boiling organic solvent, the amount of the compound of formula (III) is preferably 10% by weight or more, more preferably from 20 to 70% by weight, based on the total weight of the high boiling organic solvent used.

Examples of the high boiling point solvent which can be used in combination with the compound represented by formula (III) include those described in U.S. Pat. No. 2,322,027. Specific examples of the high boiling point organic solvent having a boiling point at normal pressure of 175° C. or higher include phthalic esters (e.g., dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoic esters (e.g., 2-ethylhexylbenzoate, dodecylbenzoate, 2-ethylhexyl-p-hydroxybenzoate), sulfonamides (e.g., N-butylbenzene sulfonamide), alcohols or phenols (e.g., isotearyl alcohol, 2,4-di-tert-amylphenol), aliphatic carboxylic esters (e.g., bis(2-ethylhexyl)sebacate, dioctyl adipate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene) and chlorinated paraffins. As the auxiliary solvent, an organic solvent having a boiling point of 30° C. or higher, preferably from 50° to about 160° C. may be used and typical examples thereof include ethyl acetate, butyl acetate, ethyl propionate, methyl ethyl ketone, cyclohexanone, 2-ethoxyethyl acetate and dimethylformamide.

In general, a light-sensitive material may be constituted to have in sequence, at least one blue-sensitive silver halide emulsion layer, at least one green-sensitive silver halide emulsion layer and at least one red-sensitive silver halide emulsion layer provided on a support. However, the sequence may be reversed. By incorporating a silver halide emulsion having sensitivity to respective wavelength region and a color coupler for forming a dye lying in a complementary color relation with the light to which the emulsion is sensitive, into a respective light-sensitive emulsion layer, color reproduction by a subtractive color process may be effected. However, the constitution may also be such that the light-sensitive emulsion layer and the coloring hue of color coupler are not in the above-described correspondence.

With respect to a silver halide emulsion or other materials (e.g., additives) and photographic constituent layers (e.g., layer arrangement) to be applied to the present invention, and a processing method and compounds used for processing the light-sensitive material, those described in JP-A-62-215272, JP-A-2-33144 and EP-A-0355660 are preferably used.

Further, silver halide color photographic light-sensitive materials and processing methods therefor described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and EP-A-0520457 are also preferably used.

A silver halide for use in the present invention may be silver chloride, silver bromide, silver chlorobromide, silver iodochlorobromide or silver iodobromide, however, for the purpose of rapid processing, a silver chlorobromide emulsion substantially free of silver iodide and having a silver chloride content of not less than 90 mol %, preferably 95 mol % or more, more preferably from 98 mol % or more, or a pure silver chloride emulsion is preferably used. The words "substantially free of silver halide" herein means the content of not more than 2 mol %, preferably not more than 0.5 mol %, and more preferably 0 mol %.

For improvement of image sharpness, the light-sensitive material of the present invention preferably contains in a hydrophilic colloid layer a dye (particularly, an oxonol dye) capable of decoloration upon processing as described in EP-A-0337490, pp. 27–76 such that the optical reflection density at 680 nm of the light-sensitive material becomes 0.70 or more, or contains in a waterproof resin layer of the support 12% by weight or more (more preferably 14% by weight or more) of titanium oxide which has been surface-treated with a di-, tri- or tetrahydric alcohol (e.g., trimethylolethane).

In the light-sensitive material of the present invention, a dye image preservability-improving compound as described in EP-A-0277589 is preferably used in combination with couplers. In particular, the compound is preferably used in combination with a pyrazoloazole-base magenta coupler.

More specifically, a compound (F) which chemically bonds to an aromatic amine developing agent remaining after color development to produce a chemically inactive and substantially colorless compound and/or a compound (G) which chemically bonds to an oxidation product of an aromatic amine color developing agent remaining after color development to produce a chemically inactive and substantially colorless compound are preferably used individually or in combination, for example, to prevent generation of stains or other side reaction due to formation of a colored dye resulting from the reaction of the developing agent or the oxidation product thereof remaining in the layer with a coupler during storage after the processing.

Further, in the light-sensitive material of the present invention, antimold as described in JP-A-63-271247 is preferably added so as to prevent various molds and bacteria which proliferate in a hydrophilic colloid layer to deteriorate the image.

The support for use in the light-sensitive material of the present invention may be either a transparent support or a reflective support. A white polyester support or a support having a layer containing a white pigment provided on the side to which a silver halide emulsion layer is formed may also be used as the support for display. Further, in order to improve the sharpness, an antihalation layer is preferably provided on the support on the side coated with a silver halide emulsion layer or on the back surface. In particular, the transmission density of the support is preferably set to from 0.35 to 0.8 so that the display can be viewed under reflection light or transmission light. Further, the transparent support may have a magnetic recording layer.

The transparent support having a magnetic recording layer may be prepared in such a manner that a polyester thin layer support previously subjected to heat treatment described in detail in JP-A-6-35118, JP-A-6-17528 and *JHI Journal of Technical Disclosure* No. 94-6023, such as a polyethylene aromatic dicarboxylate-base polyester support having a thickness of from 50 to 300 μm, preferably from 50 to 200 μm, more preferably from 80 to 115 μm, still more preferably from 85 to 105 μm, is subjected to heat treatment (annealing) at a temperature of from 40° C. to a glass transition temperature for from 1 to 1,500 hours, the support is then subjected to surface treatment such as ultraviolet irradiation described in JP-B-43-2603, JP-B-43-2604 and JP-B-45-3828, corona discharging described in JP-B-48-5043 and JP-A-51-131576 or glow discharging described in JP-B-35-7578 and JP-B-46-43480, undercoating described in U.S. Pat. No. 5,326,689 is applied thereon, a subbing layer described in U.S. Pat. No. 2,761,791 is provided, if desired, and ferromagnetic particles described in JP-A-59-23505, JP-A-4-195726 and JP-A-6-59357 are coated thereon.

The above-described magnetic layer may be in the form of a stripe described in JP-A-4-124642 and JP-A-4-124645.

The support may further be subjected to antistatic treatment described in JP-A-4-62543.

The silver halide emulsion for use in the above-described light-sensitive material includes those described in JP-A-4-166932, JP-A-3-41436 and JP-A-3-41437.

The light-sensitive material prepared as above is produced according to a production control method described in JP-B-4-86817 and the production data are preferably recorded thereon according to the method described in JP-B-6-87146. After or before the recording, the light-sensitive material is cut into a film smaller in the width than the conventional 135 size film and two perforations are formed per one small-format picture so as to match the small format picture reduced in the size than the conventional one.

The thus-prepared film is loaded before use in a cartridge package described in JP-A-4-157459, a cartridge described in JP-A-5-210202, FIG. 9, a film patrone described in U.S. Pat. No. 4,221,479 or a cartridge described in U.S. Pat. Nos. 4,834,308, 4,834,366, 5,226,613 and 4,846,418.

The film cartridge or film patrone used herein is preferably in such a type that the tongue can be housed as described in U.S. Pat. Nos. 4,848,893 and 5,317,355 in view of the light-shielding property.

A cartridge having a lock mechanism described in U.S. Pat. No. 5,296,886, a cartridge indicating the use state described in U.S. Pat. No. 5,347,334 or a cartridge having a double exposure preventing function is preferably used.

Further, a cartridge where the film can be easily loaded by merely inserting the film into the cartridge described in JP-A-6-85128 may also be used.

The thus produced film cartridge may be used for photographing and development to satisfy the object or for various photographic enjoyments using a camera, a developing machine or a lab. machine which will be described below.

The film cartridge (patrone) can exert its function sufficiently when, for example, a camera in a simple loading system described in JP-A-6-8886 and JP-A-6-99908, a camera having an automatic winding-up system described in JP-A-6-57398 and JP-A-6-101135, a camera where the film can be taken out and the kind of film can be exchanged on the way of photographing described in JP-A-6-205690, a camera where the photographing information such as panorama photographing, high-vision photographing or normal photographing (capable of magnetic recording where the print aspect ratio can be selected) can be magnetic recorded on the film described in JP-A-5-293138 and JP-A-5-283382, a camera having a double exposure preventing function described in JP-A-6-101194 or a camera having a function to indicate the use state, for example, of the film described JP-A-5-150577 is used.

The light-sensitive material of the present invention may be exposed either to visible light or to infrared light. The exposure method may be low illumination exposure or high illumination short time exposure. In the latter case, a laser scanning exposure method having an exposure time per one element of $10^{-4}$ second or shorter is preferred.

In the light exposure, a band stop filter described in U.S. Pat. No. 4,880,726 is preferably used. By using this filter, light color mixing is eliminated and the color reproducibility is outstandingly improved.

Thus photographed film may be processed in an automatic developing machine described in JP-A-6-222514 and JP-A-6-222545, the use method of magnetic recording on the film described in JP-A-6-95265 and JP-A-4-123054 may be used before, during or after the processing, or the aspect ratio selection function described in JP-A-5-19364 may be used.

In developing the film, if it is a cine-type development, the film is spliced according to the method described in JP-A-5-119461 before the processing.

During or after the development, the film may be subjected to attaching/detaching treatment described in JP-A-6-148805.

After the processing as described above, the film information may be converted into a print through back printing or front printing on a color paper according to the method described in JP-A-2-184835, JP-A-4-186335 and JP-A-6-79968.

Further, the film may be returned to the user together with the index print and the cartridge for return described in JP-A-5-11353 and JP-A-5-232594.

The yellow coupler of the present invention may also be applied to a known dry analysis element. In this field, the coupler may be called color primary body. Examples of the multilayer dry analysis element include those described in U.S. Pat. Nos. 3,992,158 and 4,042,335 and JP-A-55-164356.

The present invention is described below in greater detail with reference to examples but the present invention should not be construed as being limited thereto.

EXAMPLE 1

A multilayer color printing paper (101) having the following layer structure was prepared by subjecting the surface of a paper support having laminated on both sides thereof with polyethylene to corona discharge treatment, providing a gelatin undercoating layer containing sodium dodecylbenzenesulfonate and further coating thereon various photographic constituent layers. Coating solutions for the layers were prepared as follows.

Preparation of Coating Solution for Fist Layer

Into a mixture of 22 g of Solvent (Solv-3), 22 g of Solvent (Solv-9) and 180 ml of ethyl acetate, 122.0 g of Yellow Coupler (RY-3), 7.5 g of Dye Image Stabilizer (Cpd-2), 16.7 g of Dye Image Stabilizer (Cpd-3) and 8.0 g of Dye Image Stabilizer (Cpd-5) were dissolved, and the resulting solution was emulsified in 1,000 g of a 10% aqueous gelatin solution containing 86 ml of a 10% sodium dodecylbenzenesulfonate to prepare Emulsified Dispersion A. Separately, Silver Chlorobromide Emulsion A (cubic; a 3:7 mixture (by mol in terms of silver) of Large Size Emulsion A having an average grain size of 0.88 μm and Small Size Emulsion A having an average grain size of 0.70 μm; coefficients of variation in the grain size distribution being 0.08 and 0.10, respectively; each size Emulsion containing 0.3 mol % of silver bromide localized on a part of the grain surface comprising silver chloride as a substrate) was prepared. To each of Large Size Emulsion A and Small Size Emulsion A, Blue-sensitive Sensitizing Dyes A, B and C had been added each in an amount of $8.0\times10^{-5}$ mol for Large Size Emulsion A and in an amount of $1.0\times10^{-4}$ mol for Small Size Emulsion A. Each emulsion had been subjected to chemical ripening by adding a sulfur sensitizer and a gold sensitizer under optimum conditions.

Emulsified Dispersion A prepared above and Silver Chlorobromide Emulsion A were mixed and dissolved to prepare the coating solution for the first layer having the following composition. The coating amount of the emulsion is shown in terms of silver amount.

The coating solutions for the second to seventh layers were prepared in the same manner as the coating solution for the first layer. In each layer, 1-oxy-3,5-dichloro-s-triazine sodium salt was used as a gelatin hardening agent.

Further, to each layer, Cpd-12, Cpd-13, Cpd-14 and Cpd-15 were added to give the total amount of 15.0 mg/m$^2$, 60.0 mg/m$^2$, 5.0 mg/m2 and 10.0 mg/m$^2$, respectively, in the multilayer color printing paper.

In the silver chlorobromide emulsion of each light-sensitive emulsion layer, the following spectral sensitizing dyes were used.

Blue-sensitive Emulsion Layer:

Sensitizing Dye A

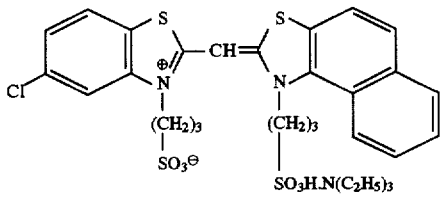

Sensitizing Dye B

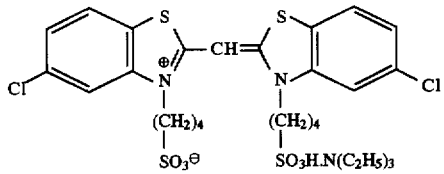

Sensitizing Dye C

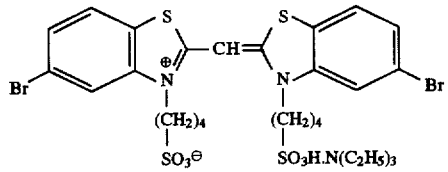

(Each dye was added in an amount of $8.0\times10^{-5}$ mol for the large size emulsion and in an amount of $1.0\times10^{-4}$ mol for the small size emulsion, per mol of silver halide.)

Green-Sensitive Emulsion Layer:

Sensitizing Dye D

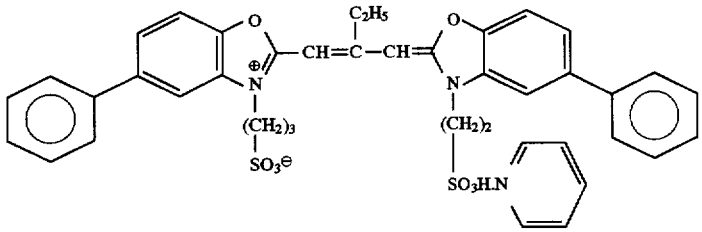

Sensitizing Dye E

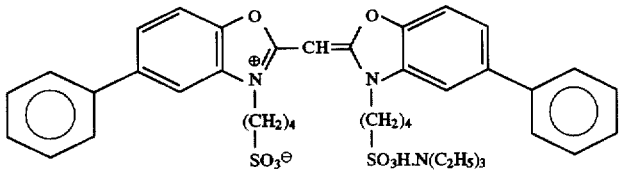

Sensitizing Dye F

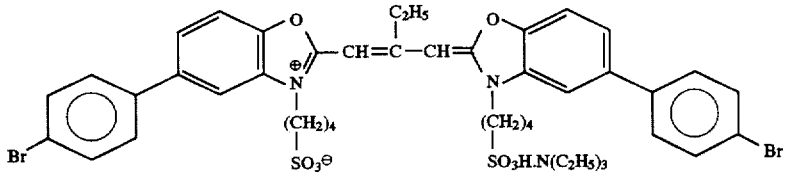

(Sensitizing Dye D was added in an amount of $3.0\times10^{-4}$ mol for the large size emulsion and in an amount of $3.6\times10^{-4}$ mol for the small size emulsion, per mol of silver halide;

Sensitizing Dye E was added in an amount of $4.0\times10^{-5}$ mol for the large size emulsion and in an amount of $7.0\times10^{-5}$ mol for the small size emulsion, per mol of silver halide; and Sensitizing Dye F was added in an amount of $2.0\times10^{-4}$ mol for the large size emulsion and in an amount of $2.8\times10^{-4}$ mol for the small size emulsion, per mol of silver halide.)

Red-Sensitive Emulsion Layer:

Sensitizing Dye G

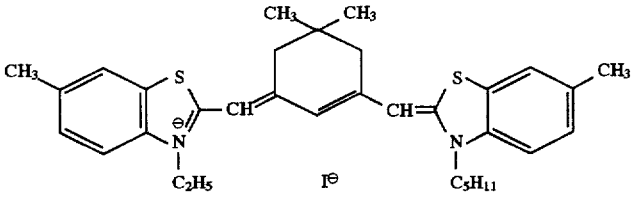

Sensitizing Dye H

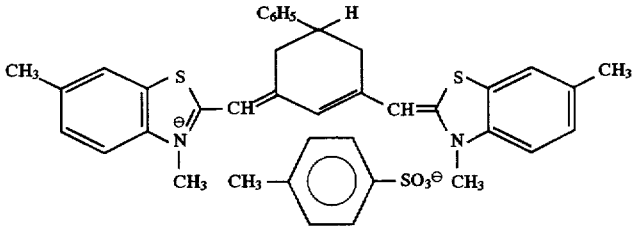

(Each dye was added in an amount of $5.0\times10^{-5}$ mol for the large size emulsion and in an amount of $8.0\times10^{-5}$ mol for the small size emulsion, per mol of silver halide.)

Further, the following compound was added in an amount of $2.6\times10^{-3}$ mol per mol of silver halide.

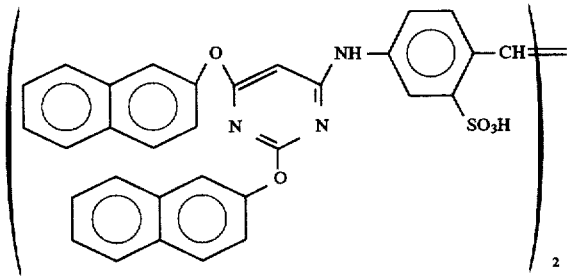

Furthermore, to the blue-sensitive emulsion layer, the green-sensitive emulsion layer and the red-sensitive emulsion layer, 1-(5-methylureidophenyl)-5-mercaptotetrazole was added in an amount of $3.3\times10^{-4}$ mol, $1.0\times10^{-3}$ mol and $5.9\times10^{-4}$ mol, per mol of silver halide, respectively. Still further, to the second, fourth, sixth and seventh layers, the compound was added to give a coverage of 0.2 mg/m$^2$, 0.2 mg/m$^2$, 0.6 mg/m$^2$ and 0.1 mg/m$^2$, respectively.

To the blue-sensitive emulsion layer and the green-sensitive emulsion layer, 4-hydroxy-6-methyl-1,3,3a,7-tetrazaindene was added in an amount of $1\times10^{-4}$ mol and $2\times10^{-4}$ mol, per mol of silver halide, respectively.

For the purpose of preventing irradiation, the following dyes (in the parentheses, the coating amounts are shown) were added to the emulsion layers.

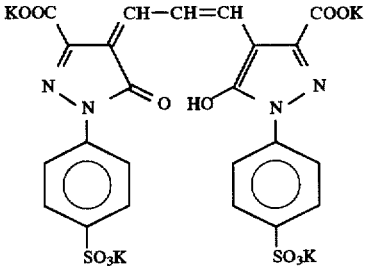

(10 mg/m$^2$)

and

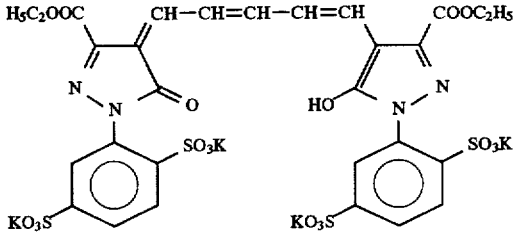

(40 mg/m$^2$)

(Layer Structure)

The layer structure of each layer is shown below. The numerals show the coating amount (g/m$^2$). With respect to the silver halide emulsion, it is shown by the coating amount calculated in terms of silver.

Support

Polyethylene laminated paper (containing a white pigment ($TiO_2$ content: 15 wt %) and a bluish dye (ultramarine) in the polyethylene on the first layer side).

| | |
|---|---|
| First Layer (Blue-sensitive Emulsion Layer) | |
| Silver Chlorobromide Emulsion A prepared above | 0.27 |
| Gelatin | 1.60 |
| Yellow Coupler (RY-3) | 0.61 |
| Dye Image Stabilizer (Cpd-2) | 0.04 |
| Dye Image Stabilizer (Cpd-3) | 0.08 |
| Dye Image Stabilizer (Cpd-5) | 0.04 |
| Solvent (Solv-3) | 0.11 |
| Solvent (Solv-9) | 0.11 |
| Second Layer (Color Mixing Preventing Layer) | |
| Gelatin | 0.99 |
| Color Mixing Inhibitor (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third Layer (Green-sensitive Emulsion Layer) | |
| Silver Chlorobromide Emulsion (cubic; a 1:3 (molar ratio as silver) mixture of Large-size Emulsion B having an average grain size of 0.55 μm and Small-size Emulsion B having an average grain size of 0.39 μm; coefficients of fluctuation in the grain size distribution being 0.10 and 0.08, respectively; each size emulsion containing 0.8 mol % of silver bromide localized on a part of the surface of a grain comprising silver chloride as a substrate) | 0.13 |
| Gelatin | 1.35 |
| Magenta Coupler (ExM-1) | 0.12 |
| Ultraviolet absorbent (UV-1) | 0.12 |
| Dye Image Stabilizer (Cpd-2) | 0.01 |
| Dye Image Stabilizer (Cpd-5) | 0.01 |
| Dye Image Stabilizer (Cpd-6) | 0.01 |
| Dye Image Stabilizer (Cpd-7) | 0.08 |
| Dye Image Stabilizer (Cpd-8) | 0.01 |
| Solvent (Solv-4) | 0.30 |
| Solvent (Solv-5) | 0.15 |
| Fourth Layer (Color Mixing Preventing Layer) | |
| Gelatin | 0.72 |
| Color Mixing Inhibitor (Cpd-4) | 0.07 |

-continued

| | |
|---|---|
| Solvent (Solv-1) | 0.05 |
| Solvent (Solv-2) | 0.15 |
| Solvent (Solv-3) | 0.12 |
| Solvent (Solv-7) | 0.09 |
| Fifth Layer (Red-sensitive Emulsion Layer) | |
| Silver Chlorobromide Emulsion (cubic; a 1:4 (molar ratio as silver) mixture of Large-size Emulsion C having an average grain size of 0.50 μm and Small-size Emulsin C having an average grain size of 0.41 μm; coefficients of fluctuation in the grain size distribution being 0.09 and 0.11, respectively; each size emulsion containing 0.8 mol % of silver bromide localized on a part of the surface of a grain comprising silver chloride as a substrate) | 0.18 |
| Gelatin | 0.80 |
| Cyan Coupler (ExC) | 0.28 |
| Ultraviolet Absorbent (UV-3) | 0.19 |
| Dye Image Stabilizer (Cpd-1) | 0.24 |
| Dye Image Stabilizer (Cpd-6) | 0.01 |
| Dye Image Stabilizer (Cpd-8) | 0.01 |
| Dye Image Stabilizer (Cpd-9) | 0.04 |
| Dye Image Stabilizer (Cpd-10) | 0.01 |
| Solvent (Solv-1) | 0.01 |
| Solvent (Solv-6) | 0.21 |
| Sixth Layer (Ultraviolet Absorbing Layer) | |
| Gelatin | 0.64 |
| Ultraviolet Absorbent (UV-2) | 0.39 |
| Dye Image Stabilizer (Cpd-7) | 0.05 |
| Solvent (Solv-8) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface Active Agent (Cpd-11) | 0.01 |

The compounds used in this Example are shown below.

Magenta Coupler (ExM-1)

A 1:1 mixture (by weight) of:

Magenta Coupler (ExM-1)

A 1:1 mixture (by weight) of:

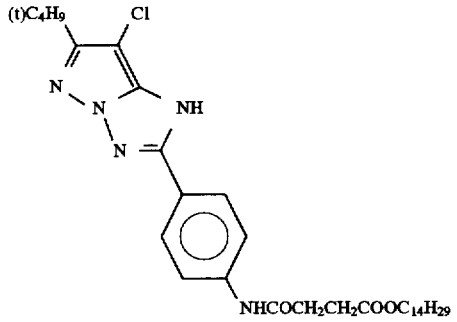

and

-continued
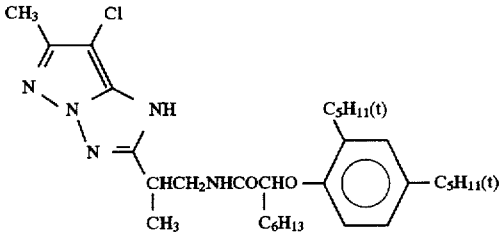
Cyan Coupler (ExC)
A 15:85 mixture (by mol) of:
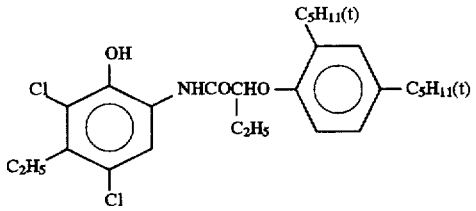
and
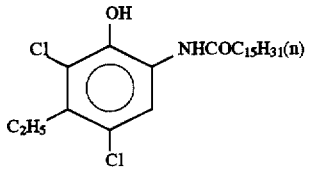
RY-1
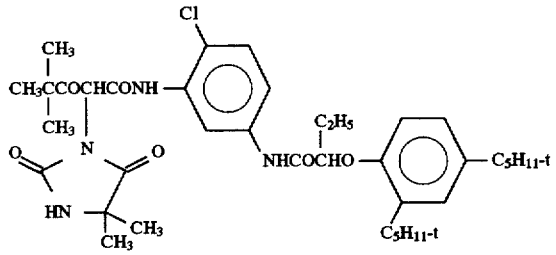
RY-2
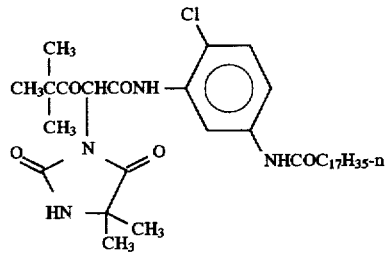

-continued
RY-3
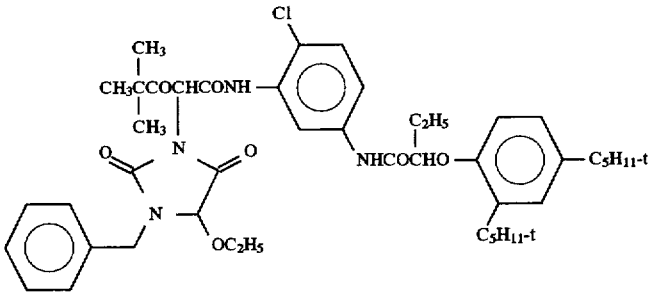
RY-4
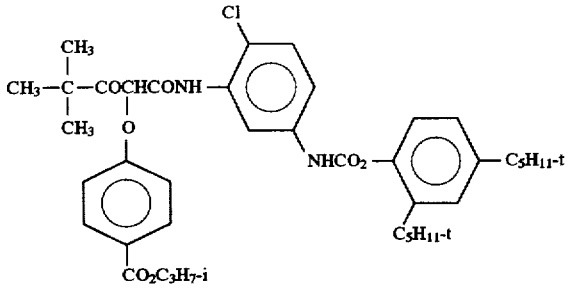
RY-5
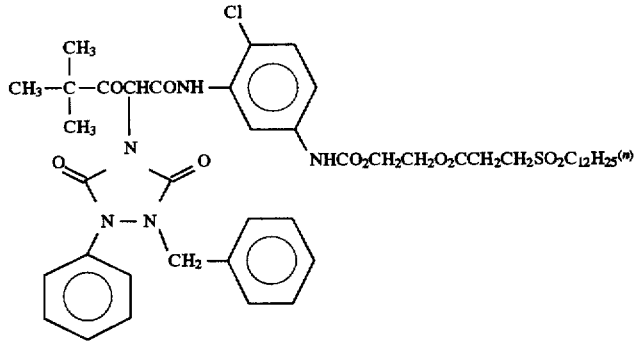
Solvent (Solv-1)
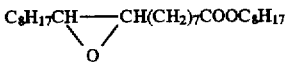
Solvent (Solv-2)
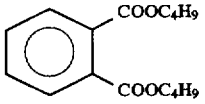
Solvent (Solvent-3)
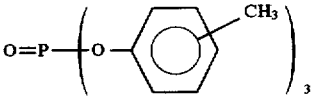
Solvent (Solv-4)
$O{=}P{+}O{-}C_6H_{13}(n)]_3$ -continued
Solvent (Solv-5)
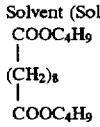
Solvent (Solv-6)
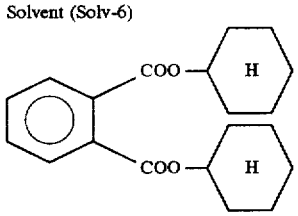
Solvent (Solv-7)
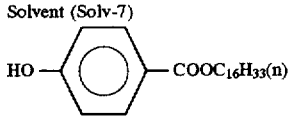
Solvent (Solv-8)
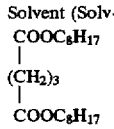
Solvent (Solv-9)
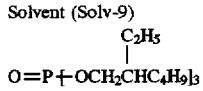
Dye Image Stabilizer (Cpd-1)
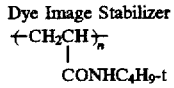
average molecular weight: 60,000
Dye Image Stabilizer (Cpd-2)
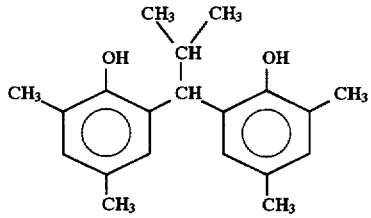
Dye Image Stabilizer (Cpd-3)
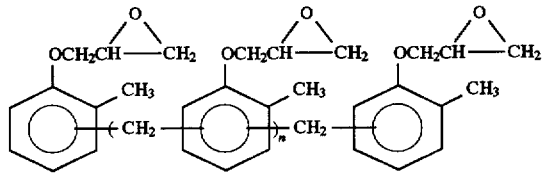
n = 7 to 8 (average)
Color Mixing Inhibitor (Cpd-4)
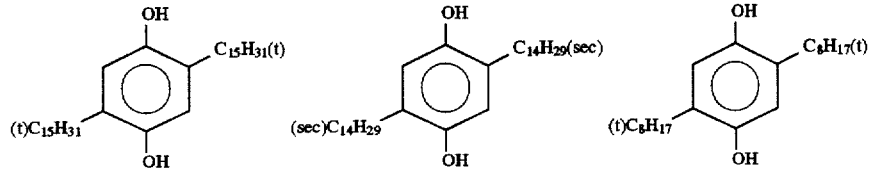

-continued
Dye Image Stabilizer (Cpd-5)
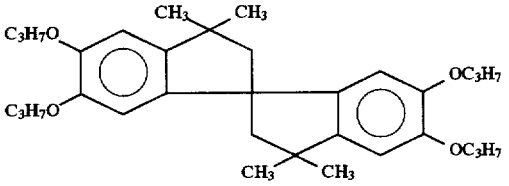
Dye Image Stabilizer (Cpd-6)
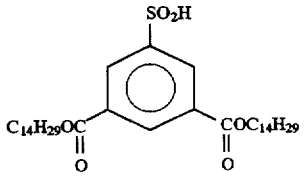
Dye Image Stabilizer (Cpd-7)
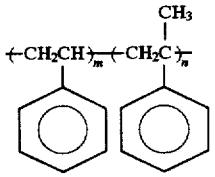
number average molecular weight: 600 m/n = 10/90
Dye Image Stabilizer (Cpd-8)
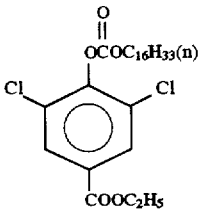
Dye Image Stabilizer (Cpd-9)
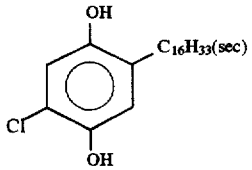
Dye Image Stabilizer (Cpd-10)
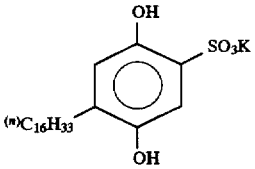
Dye Image Stabilizer (Cpd-11)
A 7:3 mixture (by weight) of:
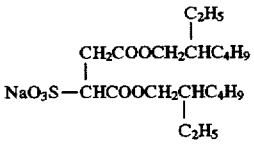
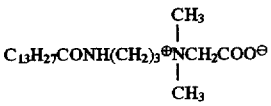

-continued
Antiseptic (Cpd-12)
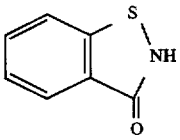
Antiseptic (Cpd-13)
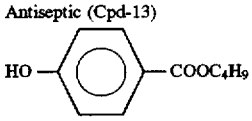
Antiseptic (Cpd-14)
A 1:1:1:1 mixture (by weight) of a, b, c and d:
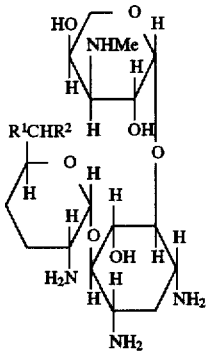
| | $R^1$ | $R^2$ |
|---|---|---|
| a | —Me | —NHMe |
| b | —Me | —$NH_2$ |
| c | —H | —$NH_2$ |
| d | —H | —NHMe |
Antiseptic (Cpd-15)
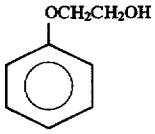
Ultraviolet (UV-1)
A 1:3:4 mixture (by weight) of (1), (2) and (3):
(1)
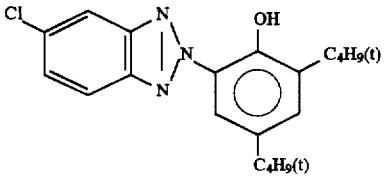
(2)
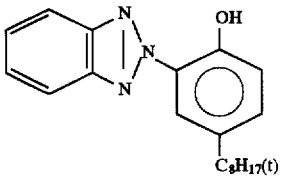
(3)
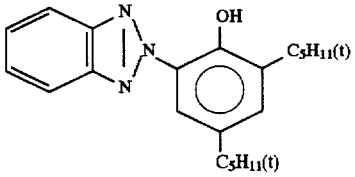
Ultraviolet (UV-2)
A 1:2:2:3:1 mixture (by weight) of (1), (2). (3), (4) and (5):

-continued
(1)
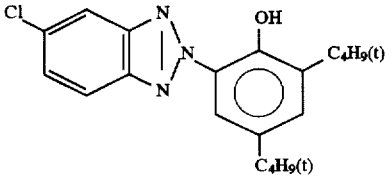
(2)
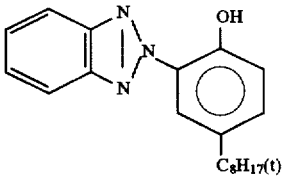
(3)
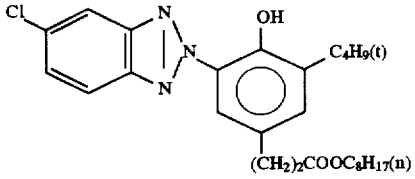
(4)
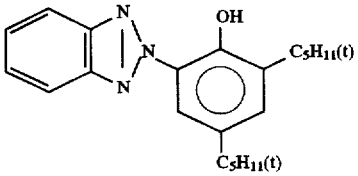
(5)
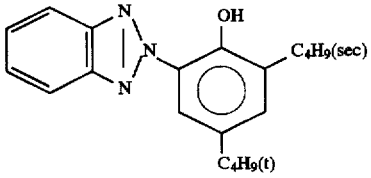
Ultraviolet (UV-3)
A 1:3:2:1 mixture (by weight) of (1), (2), (3) and (4):
(1)
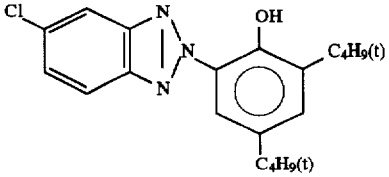
(2)
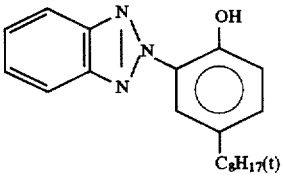
(3)
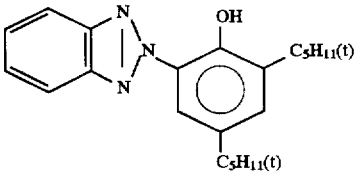

-continued (4)

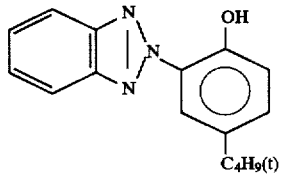

Samples 102 to 118 each was prepared thoroughly in the same manner as Sample 101 except for replacing Yellow Coupler (RY-3) in the first layer of Sample 101 as shown in Table 1. In this case, the yellow coupler was replaced by an equimolar amount of each coupler.

Further, Samples 201 to 218 were prepared using Emulsions 101 to 118, respectively, which were stored at 5° C. for 30 days.

Each sample was exposed using a sensitometry (Model FWH, manufactured by Fuji Photo Film Co., Ltd.; color temperature: 3,200K) so that about 35% of the coated silver amount was developed to give gray.

Each sample was subjected to 50-$m^2$ continuous processing using a paper processor through the following processing steps.

| Processing Step | Temperature (°C.) | Time (sec.) | Replenishing*1 Amount (ml) |
|---|---|---|---|
| Color development | 38.5 | 45 | 73 |
| Bleach-fixing | 35 | 45 | 60*2 |
| Rinsing (1) | 35 | 30 | — |
| Rinsing (2) | 35 | 30 | — |
| Rinsing (3) | 35 | 30 | 360 |
| Drying | 80 | 60 | |

*1Replenishing amount per 1 $m^2$ of the light-sensitive material
*2In addition to 60 ml of the bleach-fixing solution, 120 ml of the solution was flown thereinto from Rinsing (1) per 1 $m^2$ of the light-sensitive material. (The rinsing was in a three-tank countercurrent system from (3) to (1).)

Each processing solution had the following composition.

| | Tank Solution | Replenisher |
|---|---|---|
| Color Developer | | |
| Water | 800 ml | 800 ml |
| Ethylenediaminetetraacetic acid | 3.0 g | 3.0 g |
| 4,5-Dihydroxybenzene-1,3-disulfonic acid disodium salt | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX4, produced by Sumitoino Chemical Co., Ltd.) | 1.0 g | 3.0 g |
| Sodium sulfite | 0.1 g | 0.1 g |
| Disodium-N,N-bis(sulfnato-ethyl)hydroxylamine | 5.0 g | 10.0 g |
| Sodium triisopropyl-naphthalene(β)sulfonate | 0.1 g | 0.1 g |
| N-Ethyl-N-(β-methanesulfon-amidoethyl)-3-methyl-4-amino-aniline.3/2 sulfate monohydrate | 5.0 g | 11.5 g |
| Water to make | 1,000 ml | 1,000 ml |
| pH (25° C., adjusted with potassium hydroxide and sulfuric acid) | 10.00 | 11.00 |
| Bleach-Fixing Solution | | |
| Water | 600 ml | 150 ml |
| Ammonium thiosulfate (750 g/l) | 93 ml | 230 ml |
| Ammonium sulfite | 40 g | 100 g |
| Ammonium ethylenediamine-tetraacetate(III) | 55 g | 135 g |
| Ethylenediaminetetraacetic acid | 5 g | 12.5 g |
| Nitric acid (67%) | 30 g | 65 g |
| Water to make | 1,000 ml | 1,000 ml |
| pH (25° C., adjusted with acetic acid and aqueous ammonia) | 5.8 | 5.6 |
| Rinsing Solution | | |
| The tank solution and the replenisher were the same. | | |
| Chlorinated sodium isocyanurate | 0.02 g | |
| Deionized water (electro-conductivity: 5 μs/cm or less) | 1,000 ml | |
| pH | 6.5 | |

Each sample was subjected to gradation exposure to blue light and processed with the above-described running processing solutions. After the processing, the color density of each sample was measured using blue light and the yellow maximum color density Dmax was obtained. The results are shown in Table A.

TABLE A

| Sample | Yellow Coupler | (Coloring Property) Dmax | Sample | Emulsion after cold storage (5° C., 30 days) Dmax | Remarks |
|---|---|---|---|---|---|
| 101 | RY-3 | 2.02 | 201 | 1.92 | Comparison |
| 102 | RY-4 | 2.03 | 202 | 1.93 | Comparison |
| 103 | RY-1 | 2.03 | 203 | 1.91 | Comparison |
| 104 | RY-2 | 2.10 | 204 | 1.78 | Comparison |
| 105 | RY-5 | 2.02 | 205 | 1.93 | Comparison |
| 106 | Y-2 | 2.17 | 206 | 2.15 | Invention |
| 107 | Y-3 | 2.16 | 207 | 2.16 | Invention |
| 108 | Y-4 | 2.15 | 208 | 2.15 | Invention |
| 109 | Y-6 | 2.16 | 209 | 2.14 | Invention |
| 110 | Y-7 | 2.15 | 210 | 2.15 | Invention |
| 111 | Y-8 | 2.14 | 211 | 2.13 | Invention |
| 112 | Y-16 | 2.15 | 212 | 2.15 | Invention |
| 113 | Y-17 | 2.14 | 213 | 2.14 | Invention |
| 114 | Y-20 | 2.16 | 214 | 2.14 | Invention |
| 115 | Y-22 | 2.15 | 215 | 2.15 | Invention |
| 116 | Y-26 | 2.15 | 216 | 2.14 | Invention |
| 117 | Y-31 | 2.15 | 217 | 2.14 | Invention |
| 118 | Y-47 | 2.17 | 218 | 2.17 | Invention |

As is clearly seen from Table A, the yellow couplers of the present invention exhibited high coloring property as compared with known yellow couplers RY-1 to RY-5.

Further, the known yellow couplers were inferior in the solubility and therefore, the coloring property (Dmax) was conspicuously deteriorated when they were used after cold storage at 5° C. for 30 days, whereas the yellow couplers of the present invention underwent almost no reduction in the coloring property, revealing good solubility of the yellow couplers of the present invention.

EXAMPLE 2

Samples 301 to 325 were prepared thoroughly in the same manner as Sample 104 in Example 1 except for additionally adding 0.20 g/m2 of an amide compound as shown in Table B (co-emulsified with the yellow coupler) to the first layer. Then, each sample was processed in the same manner as in Example 1.

Then, each of the thus processed samples was subjected to light irradiation for 14 days under a fluorescent light source of 80,000 lux and the dye image remaining rate at an initial density of 1.5 was obtained. Further, each sample was stored at 80° C., 70% RH for 20 days and then the dye image remaining rate at an initial density of 1.5 was obtained. The results are shown in Table B below.

TABLE B

| Sample | Yellow Coupler | Amide Compound (0.20 g/m²) | DIRR*³ Xe | DIRR*³ 80° C.-70% RH | Remarks |
|---|---|---|---|---|---|
| 301 | RY-2 | — | 65 | 67 | Comparison |
| 302 | RY-4 | — | 63 | 65 | Comparison |
| 303 | RY-5 | — | 64 | 66 | Comparison |
| 304 | Y-2 | — | 71 | 73 | Invention |
| 305 | Y-3 | — | 75 | 77 | Invention |
| 306 | Y-4 | — | 74 | 76 | Invention |
| 307 | Y-16 | — | 75 | 76 | Invention |
| 308 | Y-31 | — | 75 | 76 | Invention |
| 309 | Y-47 | — | 70 | 71 | Invention |
| 310 | Y-3 | S-1 | 87 | 88 | Invention |
| 311 | Y-3 | S-2 | 84 | 85 | Invention |
| 312 | Y-3 | S-4 | 87 | 87 | Invention |
| 313 | Y-3 | S-5 | 86 | 87 | Invention |
| 314 | Y-3 | S-9 | 85 | 86 | Invention |
| 315 | Y-3 | S-18 | 84 | 83 | Invention |
| 316 | Y-2 | S-1 | 82 | 82 | Invention |
| 317 | Y-2 | S-4 | 81 | 81 | Invention |
| 318 | Y-4 | S-1 | 87 | 85 | Invention |
| 319 | Y-4 | S-4 | 87 | 85 | Invention |
| 320 | Y-16 | S-1 | 86 | 85 | Invention |
| 321 | Y-16 | S-4 | 84 | 84 | Invention |
| 322 | Y-31 | S-1 | 86 | 86 | Invention |
| 323 | Y-31 | S-4 | 84 | 85 | Invention |
| 324 | Y-47 | S-1 | 81 | 82 | Invention |
| 325 | Y-47 | S-4 | 80 | 81 | Invention |

*³Dye image remaining rate (%), wherein "Xe" shows the value after light exposure (80,000 lux) for 14 days, and "80° C.-70% RH" shows the value after storage at 80° C., 70% RH for 20 days.

As is clearly seen from Table B, the couplers of the present invention were superior to known yellow couplers in the fastness to heat, humidity and light. Further, By adding the amide compound of the present invention, the dye image formed from the yellow coupler of the present invention was further outstandingly improved in the fastness to light, heat and humidity. Above all, in the case of adding a diamide compound represented by formula (V), the fastness was particularly extremely improved. Further, the couplers of the present invention underwent less generation of yellow stains and in particular, in the case of Yellow Couplers Y-3 and Y-4 each having a branched alkylurethane, the generation of stains was remarkably reduced.

The yellow coupler of the present invention is excellent in the solubility, causes no reduction in the coloring property even when the emulsion is kept in cold storage for a long period of time and has superior fastness.

While the invention has been described in detail and with reference to specific embodiments thereof, it will be apparent to one skilled in the art that various changes and modifications can be made therein without departing from the spirit and scope thereof.

What is claimed is:

1. A silver halide color light-sensitive material comprising a support having thereon at least one layer containing at least one yellow dye forming coupler represented by formula (I)

(I)

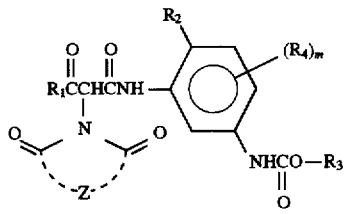

wherein $R_1$ represents an alkyl group, a cycloalkyl group, an aryl group, an alkylamino group, an anilino group or a heterocyclic group, $R_2$ represents a hydrogen atom, an aliphatic group, a halogen atom, an aliphatic oxy group, an aryloxy group or an amino group, $R_3$ represents an acyclic aliphatic group or an aryl group, $R_4$ represents a substituent, m represents 0 or an integer of from 1 to 3, and Z represents a nonmetallic atom group necessary for forming a 5-membered ring represented by formula (II-1) or (II-2):

(II-1)

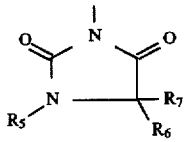

(II-2)

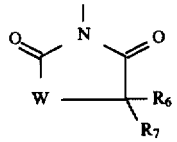

wherein $R_5$ represents a hydrogen atom; $R_6$ and $R_7$ each represents a hydrogen atom, an alkyl group having from 1 to 20 carbon atoms, an aryl group having from 6 to 26 carbon atoms, an alkoxy group having from 1 to 20 carbon atoms, an aryloxy group having from 6 to 26 carbon atoms, or a hydroxy group; W represents an oxygen atom, or a sulfur atom; or said yellow dye forming coupler being linked at the site of $R_1$, $R_2$, $R_4$ or Z through a divalent or other polyvalent group to form a dimer or polymer.

2. A silver halide color light-sensitive material comprising a support having thereon at least one layer containing at least one yellow dye forming coupler represented by formula (I)

(I)

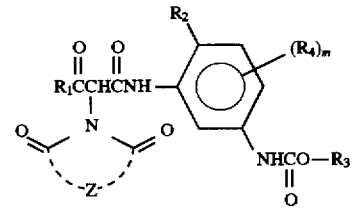

wherein $R_1$ represents an alkyl group, a cycloalkyl group, an aryl group, an alkylamino group, an anilino group or a heterocyclic group, $R_2$ represents a hydrogen atom, an aliphatic group, a halogen atom, an aliphatic oxy group, an aryloxy group or an amino group, $R_3$ represents an unsubstituted branched alkyl group, $R_4$ represents a substituent, m represents 0 or an integer of from 1 to 3, and Z represents a nonmetallic atom group necessary for forming a 5-membered ring represented by formula (II-1) or (II-2):

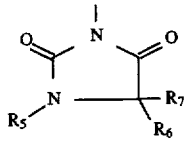

(II-1)

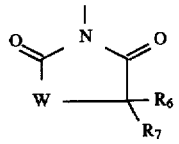

(II-2)

wherein $R_5$ represents a hydrogen atom; $R_6$ and $R_7$ each represents a hydrogen atom, an alkyl group having from 1 to 20 carbon atoms, an aryl group having from 6 to 26 carbon atoms, an alkoxy group having from 1 to 20 carbon atoms, an aryloxy group having from 6 to 26 carbon atoms, or a hydroxy group; W represents an oxygen atom, or a sulfur atom; or said yellow dye forming coupler being linked at the site of $R_1$, $R_2$, $R_4$ or Z through a divalent or other polyvalent group to form a dimer or polymer.

3. A silver halide color light-sensitive material as claimed in claim 1, wherein the layer containing the yellow dye forming coupler further contains a compound represented by formula (III)

$$R_{31}CON(R_{32})R_{33} \quad \text{(III)}$$

wherein $R_{31}$, $R_{32}$ and $R_{33}$ each independently represents a hydrogen atom, an aliphatic group or an aryl group, or $R_{31}$ and $R_{32}$ or $R_{32}$ and $R_{33}$ may be linked to form a ring, provided that the total number of the carbon atoms of $R_{31}$, $R_{32}$ and $R_{33}$ is from 9 to 80; or said compound being linked at the site of $R_{31}$, $R_{32}$ or $R_{33}$ to form an oligomer or polymer with no limitation on the total number of the carbon atoms of $R_{31}$, $R_{32}$ and $R_{33}$.

4. A silver halide color light-sensitive material as claimed in claim 1, wherein $R_1$ in formula (I) is a t-butyl group, a 1-methylcyclopropyl group, a 1-ethylcyclopropyl group, a 1-benzylcyclopropyl group, a 4-methoxyphenyl group, or an indolinyl group.

5. A silver halide color light-sensitive material as claimed in claim 1, wherein $R_2$ in formula (I) is a halogen atom, an aliphatic oxy group, or an aryloxy group.

6. A silver halide color light-sensitive material as claimed in claim 2, wherein $R_3$ in formula (I) is an unsubstituted branched alkyl group having from 8 to 18 carbon atoms.

7. A silver halide color light-sensitive material as claimed in claim 1, wherein $R_4$ in formula (I) is an aliphatic group having from 1 to 30 carbon atoms, an aliphatic oxy group having from 1 to 30 carbon atoms, an acylamino group having from 2 to 30 carbon atoms, a carbamoyl group having from 1 to 30 carbon atoms, an alkoxycarbonyl group having from 2 to 30 carbon atoms, an alkylsulfonamide group having from 1 to 30 carbon atoms, an arylsulfonamide group having from 6 to 36 carbon atoms, a cyano group, a nitro group, or a halogen atom.

8. A silver halide color light-sensitive material as claimed in claim 3, wherein the compound of formula (III) is a compound represented by formula (IV)

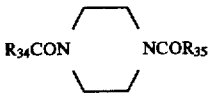

(IV)

wherein $R_{34}$ and $R_{35}$ each has the same meaning as defined for $R_{31}$ in formula (III) and the total carbon number of $R_{34}$ and $R_{35}$ is from 12 to 75.

9. A silver halide color light-sensitive material as claimed in claim 8, wherein $R_{34}$ and $R_{35}$ are the same.

10. A silver halide color light-sensitive material as claimed in claim 9, wherein $R_{34}$ and $R_{35}$ are an alkyl group having from 8 to 26 carbon atoms.

11. A silver halide color light-sensitive material as claimed in claim 8, wherein $R_{34}$ and $R_{35}$ are a branched alkyl group represented by formula (V)

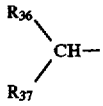

(V)

wherein $R_{36}$ represents a linear or branched alkyl group having from 4 to 13 carbon atoms and $R_{37}$ represents a linear or branched alkyl group having from 2 to 11 carbon atoms.

12. A silver halide color light-sensitive material as claimed in claim 11, wherein $R_{36}$ represents a branched alkyl group having from 7 to 13 carbon atoms and $R_{37}$ represents a branched alkyl group having from 5 to 11 carbon atoms.

13. A silver halide color light-sensitive material as claimed in claim 12, wherein $R_{36}$ represents a branched alkyl group having from 9 to 10 carbon atoms and $R_{37}$ represents a branched alkyl group having from 7 to 8 carbon atoms.

14. A silver halide color light-sensitive material as claimed in claim 13, wherein the number of carbon atoms in $R_{37}$ is 2 smaller than that in $R_{36}$.

15. A silver halide color light-sensitive material as claimed in claim 1, wherein the yellow dye forming coupler of formula (I) is contained in an amount of from 0.01 to 10 $mmol/m^2$.

16. A silver halide color light-sensitive material as claimed in claim 3, wherein the compound of formula (III) is contained in an amount of from 0.0002 to 20 $g/m^2$.

17. A silver halide color light-sensitive material as claimed in claim 3, wherein the amount of the compound of formula (III) is from 0.1 to 8 parts by weight per part by weight of the yellow dye forming coupler of formula (I).

18. A silver halide color light-sensitive material as claimed in claim 3, wherein the compound of formula (III) is present in a co-emulsified state with the yellow dye forming coupler.

19. A silver halide color light-sensitive material as claimed in claim 1, wherein the yellow dye forming coupler of formula (I) is contained in a silver halide emulsion layer, the silver halide of which contains at least 90 mol % of silver chloride.

20. A silver halide color light-sensitive material as claimed in claim 3, wherein the yellow dye forming coupler of formula (I) and the compound of formula (III) are contained in a silver halide emulsion layer, the silver halide of which contains at least 90 mol % of silver chloride.

21. A silver halide color light-sensitive material as claimed in claim 1, wherein Z is represented by formula (II-2).

* * * * *